US005471007A

United States Patent [19]

Van Duyne et al.

[11] Patent Number: 5,471,007

[45] Date of Patent: Nov. 28, 1995

[54] MULTIDIMENSIONAL DIGITAL WAVEGUIDE SIGNAL SYNTHESIS SYSTEM AND METHOD

[75] Inventors: Scott A. Van Duyne, Stanford; Julius O. Smith, III, Palo Alto, both of Calif.

[73] Assignee: The Board of Trustees of the Leland Stanford Junior University, Stanford, Calif.

[21] Appl. No.: 57,253

[22] Filed: May 4, 1993

[51] Int. Cl.[6] ..... G10H 1/02; G10H 1/12; G10H 1/46

[52] U.S. Cl. ..... 84/622; 84/659

[58] Field of Search ..... 84/622, 659; 333/28 R, 333/28 T, 157, 629, 633, DIG. 9, DIG. 10

[56] References Cited

U.S. PATENT DOCUMENTS 4,984,276 1/1991 Smith .

*Primary Examiner*—William M. Shoop, Jr.
*Assistant Examiner*—Jeffrey W. Donels
*Attorney, Agent, or Firm*—Flehr, Hohbach, Test, Albritton & Herbert

[57] ABSTRACT

A signal synthesizer uses a digital waveguide network having at least a two dimensional matrix of waveguide sections interconnected by junctions to filter one or more excitation signals so as to generate an array of synthesized output signals. The digital waveguide network has sets of waveguide sections interconnected by junctions. Each waveguide section includes two digital delay lines running parallel to each other for propagating signals in opposite directions and each junction has reflection and propagation coefficients assigned to it for controlling reflection and propagation of signals in the waveguide sections connected to that junction. Except for junctions along boundaries of the digital waveguide matrix, each junction is at least a four-way junction that interconnect at least four waveguide sections so as to scatter and intermix signals in flowing through those waveguide sections. At least one signal source, coupled to specified junctions of the digital waveguide network, provides excitation signals to the digital waveguide network. In addition, a parameter memory stores sets of control parameters, including waveguide control parameters for controlling how the digital waveguide network filters signals propagating therethrough and signal source parameters which govern the excitation signals produced by the signal source or sources. Finally, a digital signal processor or controller operates the signal sources and digital waveguide network using a selected set of the control parameters so as to synthesize an array of output signals.

10 Claims, 24 Drawing Sheets

Three-Port Scattering Junction

Four-Port Scattering Junction

Five-Port Scattering Junction

A-58232/GSW
S93-071

MULTIDIMENSIONAL DIGITAL WAVEGUIDE SIGNAL SYNTHESIS SYSTEM AND METHOD

The present invention relates generally to systems and methods for generating signals representing a multi-dimensional traveling wave, and particularly to a computationally efficient system and method for synthesizing such signals using a multi-dimensional array of digital waveguide sections interconnected by scattering junctions. An initial preferred embodiment of the present invention is used to synthesize musical sounds, such as the sounds generated by a drum.

BACKGROUND OF THE INVENTION

The use of digital waveguide networks for digital signal processing and musical synthesis is disclosed in U.S. Pat. No. 4,984,276, which teaches the use of digital processors having digital waveguide networks for digital reverberation and for synthesis of musical sounds such as those associated with reed and string instruments.

The present invention is an extension or specific implementation of the digital waveguide networks disclosed in U.S. Pat. No. 4,984,276. In particular, the inventors have found that a two-dimensional matrix of digital waveguides interconnected by four-way scattering junctions is an extremely efficient method for modeling wave propagation in a membrane or in an acoustic plane.

The traveling wave solution to the wave equation for an ideal string or acoustic tube can be modeled efficiently using Digital Waveguides. In the Digital Waveguide, two arbitrary traveling waves propagate independently in their respective left and right directions, while the physical wave amplitude at any point may be obtained by summing the left- and right-going waves. The simplicity with which the waveguide formulation plugs into linear systems and network theory has driven research in physical modeling. Many applications of the one-dimensional digital waveguide are known. Motivation for the two-dimensional digital waveguide mesh, as presented here, is found in applications to drums, soundboards, gongs, pianos, and other acoustic constructs where a one-dimensional model is less desirable.

In the two dimensional membrane case, the traveling wave solution involves the integral sum of an infinite number of arbitrary plane waves traveling in all directions:

$$u_{tt}(t,x,y) = c^2[u_{xx}(t,x,y) + u_{yy}(t,x,y)]$$

$$u(t,x,y) = \int f_\alpha(x\cos\alpha + y\sin\alpha - ct)d\alpha$$

Finite element and difference equation methods are known which can help with the numerical solution to this problem. However, these methods have had two drawbacks: (1) their heavy computational time is orders of magnitude beyond reach of real time, and (2) traditional problem formulations fit only awkwardly into the physical model arena of linear systems, filters, and network interactions.

Proposed in this document is a formulation of the N-dimensional wave equation in terms of a network of bi-directional delay elements and multi-port scattering junctions. The essential structure of the two-dimensional membrane case is a layer of parallel vertical waveguides superimposed on a layer of parallel horizontal waveguides intersecting each other at 4-port scattering junctions between each bi-directional unit delay. The 4-port junctions may be implemented with no multiplies in the equal impedance case, greatly reducing computation cost. FIG. 1 shows three snapshots of a wave propagating in the 2-D mesh excited with the initial deflection shown.

If we view the mesh as a lattice of interconnected vibrating strings, the displacement velocities at the four ports of each junction must be equal, and the forces at each junction must sum to zero; in this case, we have series scattering junctions with force or velocity waves traveling in the two-port, bi-directional unit delays. On the other hand, if we view the mesh as a lattice of interconnected acoustic tubes, the pressures at each junction must be equal, and the flows into each junction must sum to zero; in this case, we have parallel scattering junctions with pressure or volume velocity waves traveling through the delay units.

Since the waveguide mesh is a linear system, any losses modeled in the bi-directional delay elements can be pushed around the system and consolidated as desired. The waveguide mesh assumes nothing about its boundary conditions or initial values, and combines in a straightforward way with other filter and waveguide system elements. In addition, it is well-suited for parallel processor implementation: The scattering junction computations may be performed in any order in a first pass; then the delays may be performed in any order in a second pass. The waveguide mesh extends easily to the three- and N-dimensional cases.

The two-dimensional waveguide mesh is mathematically equivalent to the standard second-order difference equation in the lossless case, where the time and spatial sampling interval are taken to be equal and the speed of wave propagation is taken to be $2^{0.5}$ spatial samples per time sample:

$$\upsilon_{l,m}(n)+\upsilon_{l,m}(n-2)= 0.5[\upsilon_{l,m+1}(n-1)+\upsilon_{l,m-1}(n-1)]+0.5[\upsilon_{l+1,m}(n-1)+\upsilon_{l-1,m}(n-1)],$$

where l and m index the spatial samples and n indexes time.

However, the numerical solution methods of initial value problems involving second order hyperbolic partial difference equations usually require a multi-step time scheme which retains values for at least two previous time frames. The waveguide mesh reduces this structure to a one-step time scheme where each new time frame may be computed wholly from the previous time frame. This is made possible by the use of traveling wave components in place of physical wave variables.

Since most signal synthesizers are implemented using either general purpose computers or digital data processors, or special purpose digital signal processors, computational efficiency is always a concern. In general purpose computers, multiplication usually takes longer than addition. When using digital signal processors, while multiplication can be performed in the same amount of time (e.g., one CPU clock cycle) as an addition, multiplier circuits consume considerably more space than adders, and therefore having multiple parallel multiplier circuits for vector data processing is much more expensive than having a similar number of parallel adders. The object of the present invention is to provide a real time two-dimensional traveling wave signal synthesizer that is computationally efficient.

SUMMARY OF THE INVENTION

In summary, the present invention is a signal synthesizer that uses a digital waveguide network having at least a two dimensional matrix of waveguide sections interconnected by junctions to filter one or more excitation signals so as to generate an array of synthesized output signals. The digital waveguide network has sets of waveguide sections interconnected by junctions.

Each waveguide section includes two digital delay lines running parallel to each other for propagating signals in opposite directions and each junction has reflection and propagation coefficients assigned to it for controlling reflection and propagation of signals in the waveguide sections connected to that junction. Except for junctions along boundaries of the digital waveguide matrix, each junction is at least a four-way junction that interconnect at least four waveguide sections so as to scatter and intermix signals in flowing through those waveguide sections.

At least one signal source, coupled to specified junctions of the digital waveguide network, provides excitation signals to the digital waveguide network. In addition, a parameter memory stores sets of control parameters, including waveguide control parameters for controlling how the digital waveguide network filters signals propagating therethrough and signal source parameters which govern the excitation signals produced by the signal source or sources. Finally, a digital signal processor or controller operates the signal sources and digital waveguide network using a selected set of the control parameters so as to synthesize an array of output signals.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

1. The Digital Signal x(n), y(n), $L_i(n)$, $L_o(n)$, etc. shall represent digital signals indexed by n, an integer. The time index n represents a sampled time instant. Increasing n indicates forward progression in time. x(n) is the value of the signal at time n, x(n+1) is the value of the signal at time n+1, etc.

2. The Unit Delay

Figure 2:
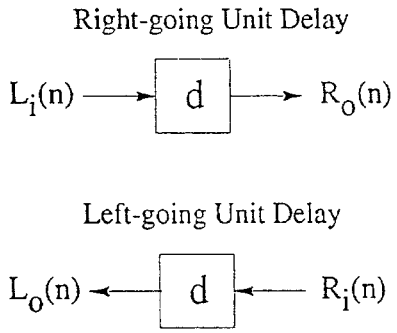
FIG. 2, 3, 4, 5, and 6 show the construction of various delay elements.

The Unit Delay, represented in FIG. 2 by the letter, d, surrounded by a box, delays a signal sequence by one time sample. It is characterized by an input signal, an output signal, and a delay length of one time sample. L and R stand for left and right, respectively. Subscripts i and o stand for input and output, respectively. For example, $L_i(n)$ stands for the left side input signal at time index n; $R_o(n)$ stands for the right side output signal at time n; and so forth. The arrows indicate the direction of signal flow through the delay operator. In the Right-going unit delay, a signal value presented at the left input is moved to the output on the right after a delay of one time sample. This operation may be expressed algebraically as follows: $R_o(n)=L_i(n-1)$ for all integers, n. Similarly, a left-going delay unit is defined by $L_o(n)=R_i(n-1)$.

3. The Delay Line

Figure 3:
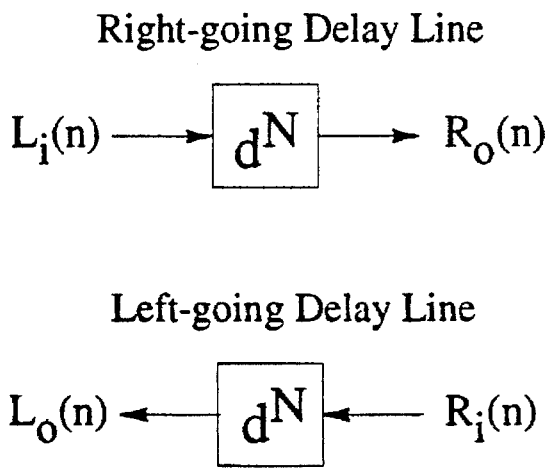

The Delay Line is an extension of the Unit Delay to arbitrary integer length of time delay. It is characterized by an input signal, an output signal, and an arbitrary delay length, N time samples. See FIG. 3. L and R stand for left and right, respectively. Subscripts i and o stand for input and output, respectively. For example, $L_i(n)$ stands for the left side input signal at time index n; $R_o(n)$ stands for the right side output signal at time n; and so forth. The arrows indicate the direction of signal flow through the delay operator. In the Right-going delay line, a signal value presented at the left input is moved to the output on the right after a delay of some N time samples. This operation may be expressed algebraically as follows: $R_o(n)=L_i(n-N)$ for all integers, n. Similarly, a left-going delay line is defined by $L_o(n)=R_i(n-N)$.

4. The Digital Waveguide

The Digital Waveguide is the superposition of one left-going delay line and one right-going delay line. See FIG. 4. It is characterized by two inputs, two outputs, a delay length N, and a wave impedance, Z. There is one input on each side and one output on each side. The delay length in each of the delay lines is the same, i.e., N samples.

The computation of the Digital Waveguide element may be expressed algebraically as follows: $R_o(n)=L_i(n-N)$, $L_o(n)=R_i(n-N)$, for all integer n. The wave impedance, Z, defined for the Waveguide does not figure into the computation equations for the Waveguide. However, it does influence the way several Waveguides interconnected at Scattering Junctions will interact. This is explained below in the description of Scattering Junctions.

We introduce a short hand schematic notation for the Digital Waveguide where one line with two arrows in opposite directions shall be more convenient to visualize than the full notation of two separate left- and right-going delay lines. See FIG. 5. This notation also emphasizes the unification of the two delay line elements into one two-port network element, the Digital Waveguide.

5. Ports

Figure 4:
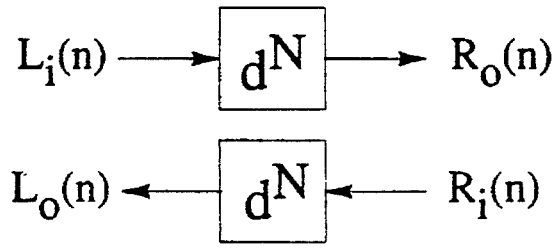
Figure 5:
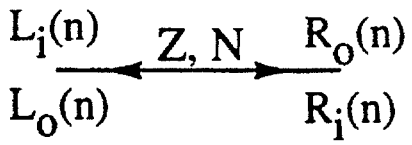

A port is defined as an input-output pair. For example, the Digital Waveguide in FIGS. 4 and 5 is a two-port network element where $L_i(n)$ and $L_o(n)$ comprise one port on the left side, and $R_i(n)$ and $R_o(n)$ comprise a second port on the right side.

6. The Bi-Directional Unit Delay

Figure 6:
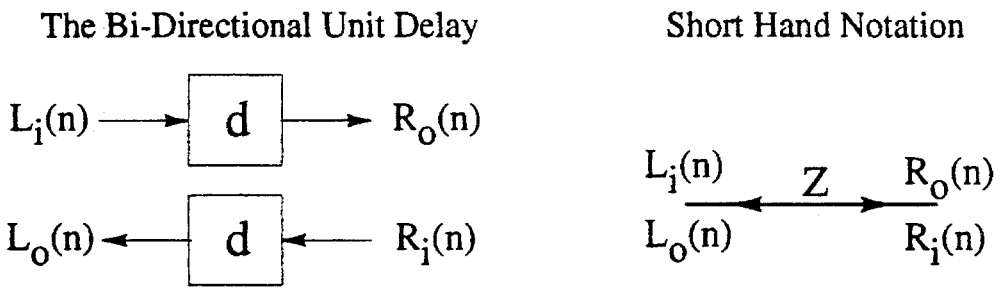

The Bi-Directional Unit Delay is a special case of the digital Waveguide where the delay length, N, is taken to be one time sample. FIG. 6 shows the Bi-Directional Unit Delay and its short hand notation. The Bi-Directional Unit Delay is a two-port Network Element characterized by two input-output pairs, a delay length of one time sample and a wave impedance, Z. The computation of the Bi-Directional Unit Delay element may be expressed algebraically as follows: $R_o(n)=L_i(n-1)$, $L_o(n)=R_i(n-1)$, for all integers, n.

7. Two-Port Scattering Junction

Figure 7:
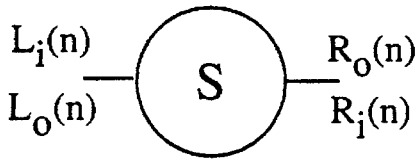
FIG. 7, 8 and 9 show a two-port scattering junction and its connections with two waveguides.

The Scattering Junction, represented by the circumscribed letter, S, in FIG. 7, is a method used to interconnect two or more Digital Waveguides (or Bi-Directional Unit Delays, which are a special case of Digital Waveguides). It is characterized by two or more input-output pairs, or ports. The exact method of computation of the outputs from the inputs is dependent on the wave impedances of the Waveguides connected to them.

Two-Port Scattering Junction is characterized two input-output pairs and a scattering algorithm to compute the outputs from the inputs. See FIG. 7.

The computation of the outputs of the Scattering Junction is dependent on the inputs and on the wave impedances of the Waveguides connected to each of its ports, but not dependent on the lengths of the connecting Waveguides. To describe the Scattering Junction computation algorithm we first construct a Network of two Waveguides and a Two-Port Scattering Junction. See FIG. 8.

Figure 8:
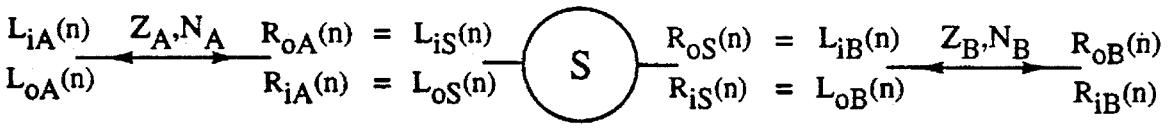

In the center of the diagram in FIG. 8 is a Scattering Junction with its left and right input-output pairs marked. The inputs and outputs are subscripted with and S to indicate that they are to be associated with the Scattering Junction and not the surrounding Waveguides. On the left of the diagram is a waveguide with all of its parameters subscripted with the letter A. We shall call this Waveguide A. Similarly, on the right side of the diagram is Waveguide B, with all of its parameters subscripted with the letter B. In the diagram, four equal signs (=) are shown which indicate the equalities: $R_{oA}(n)=L_{iS}(n)$, $R_{iA}(n)=L_{oS}(n)$, $R_{oS}(n)=L_{iA}(n)$, and $R_{iS}(n)=L_{oB}(n)$. These four equalities indicate, respectively, that the right output of Waveguide A is coincident with the left input of the Scattering Junction, S; that the right input of Waveguide A is coincident with the left output of S; that the right output of S is coincident with the left input of Waveguide B; and that the right input of S is coincident with the left output of Waveguide B.

Due to the coincidence of these values, an order of computation must be established. The general solution to order of computation of the network elements is treated below. However, in this example the Waveguides are to be computed first so that $R_{oA}(n)$ and $L_{oB}(n)$ are known. Thus, the inputs of the Scattering Junction, $L_{iS}(n)$ and $R_{iS}(n)$, are known by the stated equalities.

Now computation of the Scattering Junction proceeds according to the following two step algebraic procedure:

Step 1. A temporary value, $v_J$ is computed:

$$v_J=2(Z_A\ L_{iS}(n)+Z_B\ R_{iS}(n))/(Z_A+Z_B)$$

Step 2. The outputs are computed from $v_J$ and the inputs:

$$L_{oS}(n)=v_J-L_{iS}(n)$$

$$R_{oS}(n)=v_J-R_{iS}(n)$$

There are other equivalent formulas for this computation which reduce the number of multiplications necessary to compute the outputs from the inputs. For example in Step 1, the values $c_1=2\ Z_A/(Z_A+Z_B)$ and $c_2=2\ Z_B/(Z_A+Z_B)$ could be computed in advance and Step 1 replaced with:

$$v_J=c_1\ L_{iS}(n)+c_2\ R_{iS}(n)$$

thus reducing the computation from three multiplies, one divide and one add to two multiplies and one add.

Note that the computation of the Scattering Junction is dependent on the wave impedances of the interconnected waveguides, $Z_A$ and $Z_B$, but not on their delay lengths, $N_A$ and $N_B$.

8. Short Hand Schematic Notation

Figure 9:
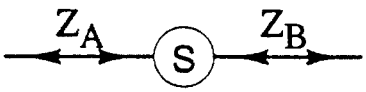

When the context is understood the short hand schematic notation shown in FIG. 9 may be used for the two-port scattering example in Section 7. The Scattering Junction, S, is completely determined by $Z_A$ and $Z_B$.

9. N-Port Scattering Junctions

Any number of Waveguides may be interconnected at a Scattering Junction. If N Waveguides are interconnected, then we require an N-Port Scattering Junction. If the wave impedances of the N Waveguides are $Z_k$, where k=1,2,3, . . . ,N; the N inputs to the Scattering Junction are $i_k$, where k=1,2,3, . . . ,N; and the N outputs from the Scattering Junction are $o_k$, where k=1,2,3, . . . ,N; then the output may be computed from the inputs in a two step process consistent with that given in Section 7:

Step 1. A temporary value, $v_J$ is computed:

$$v_J=(2\Sigma_k\ Z_k\ i_k)/\Sigma_k\ Z_k,$$

where k counts from 1 to N.

Equivalently, we may write this algebraic expression:

$$v_J=2(Z_1\ i_1+Z_2\ i_2+\ldots+Z_N\ i_N)/(Z_1+Z_2+\ldots+Z_N)$$

Step 2. The outputs are computed from $v_J$ and the inputs:

$$o_k=v_J-i_k,$$

where k=1,2,3, . . . ,N.

Figure 10:
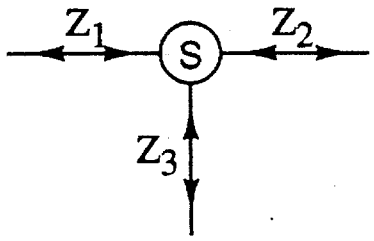
FIGS. 10 and 11 show a variety of N-port scattering junctions.
Figure 10:
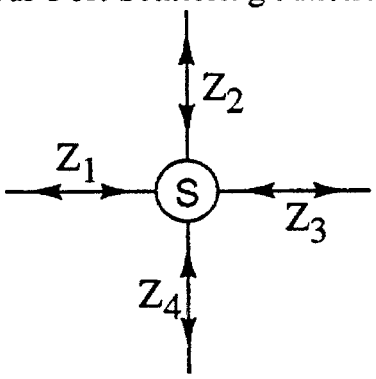
Figure 10:
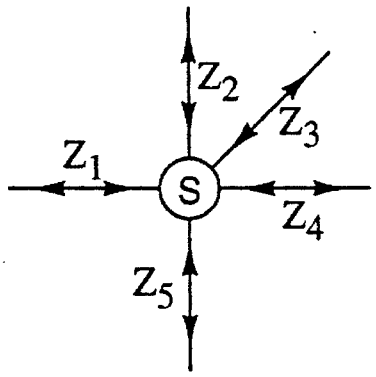

Examples of N-Port Scattering Junctions with the wave impedances of the connected Waveguides shown appear in FIG. 10.

10. The Equal Impedance Four-Port Scattering Junction

Figure 11:
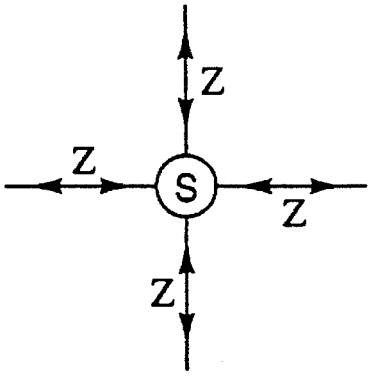

The Equal Impedance Four-Port Scattering Junction is a special case of the N-Port Scattering Junction. It is characterized by four input-output pairs which connect four waveguides whose wave impedances are all the same value, Z. See FIG. 11. It may be seen that the Scattering Junction computation equations reduce to the following:

Step 1. A temporary value, $v_J$ is computed:

$$v_J=(1/2)(i_1+i_2+i_3+i_4)$$

Step 2. The outputs are computed from $v_J$ and the inputs:

$$o_k=v_J-i_k,$$

where k=1,2,3,4.

This computation evidently requires seven adds (or subtracts) and one divide by two. If the computation is performed on a digital computing machine in fixed point binary numbers, the divide by 2 may be implemented by a shift one bit to the right. Therefore, there need be no multiplies or divides in this computation.

11. The Truncation Method of 4-Port Junction Computation

When computing the Scattering Junctions in the context of a digital computing machine, it is customary to work the computation in a signed fixed point binary arithmetic. In this environment, the computation of $v_J$ in Step 1 in the Equal Impedance 4-Port Scattering Junction requires a divide by 2. This operation may be efficiently implemented by a sign-preserving right shift of one bit. This method results in a truncation which rounds toward zero in the case of positive numbers and rounds away from zero in the case of negative numbers. This is a round down in both cases. This method may introduce over time a negative offset into the values of the mesh which may eventually lead to instability or reduced dynamic range if there is no loss in the system somewhere else.

12. The Rounding Method of 4-Port Junction Computation

An alternative is to round positive values and negative values both toward zero. In this case no overall energy will be added to the mesh. However, due to the large number of Scattering Junctions in the mesh, this method can result in a fairly quick decay of energy in the mesh. If such a decay is not desirable or not tolerable in the system, then the Energy Preserving 4-Port Junction Computation should be used.

13. The Energy Preserving 4-Port Junction Computation

The Energy Preserving computation method takes advantage of the fact that when shifting a binary number to the right, there are exactly two cases: (1 ) the bit shifted off the end (called the Low-Order Bit) is zero and the computation is exact, or (2) the Low-Order Bit is 1 and the error is exactly 0.5. In computing the Scattering Junction outputs this error is magnified by 4 in Step 2 of the calculation, since it is summed into the output of four ports.

The Energy Preserving Method takes note of the fact that 0.5 times 4 equals 2. In computing the outputs in the case where the Low-Order Bit is zero, the ordinary truncation method of junction computation produces an exact result and should be used. In the case where the Low-Order Bit is 1, then the outputs to two ports should be rounded up and the outputs to the other two ports should be rounded down. Now no overall offset is introduced into the system, since two outputs are inexact by +0.5 and two outputs are inexact by −0.5. The choice of which ports to round up and which ports to round down is arbitrary or may be made by some design or may be chosen at random or in some pattern. This method assures against no degrading loss being introduced and no accumulating offset which may lead to instability or reduced dynamic range.

14. The 2-D Digital Waveguide Mesh

Figure 12:
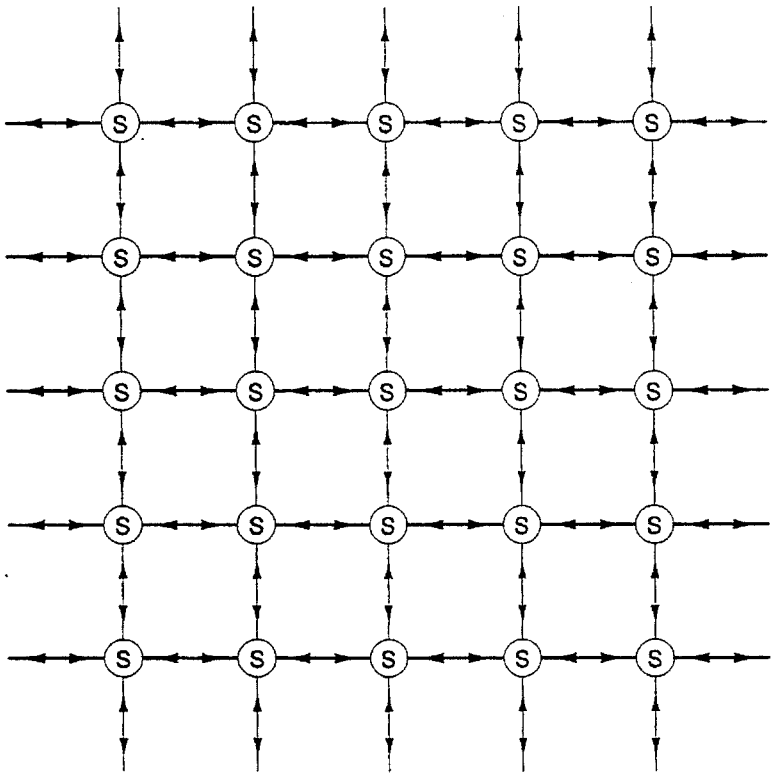
FIG. 12 is a diagram of the 2-D Digital Waveguide Mesh.

The 2-D Digital Waveguide Mesh is constructed by interconnecting a lattice of bi-directional Unit Delays with Equal Impedance 4-Port Scattering Junctions. FIG. 12 shows the layout of a portion of this mesh. All the Waveguide sections in the mesh are taken to be bi-directional unit delays and their wave impedances are all taken to be equal to each other. Therefore, the computation of the Scattering Junctions in the mesh do not depend on the wave impedances of the interconnected Waveguides. This mesh may be generalized to include the cases where the Waveguide lengths are not 1, and are not equal. In addition the associated wave impedances may vary from one to the other, so that the Scattering Junctions are now no longer Equal Impedance. The equal impedance, bi-directional unit delay constructed mesh is characterized fully by its layout in two dimensions and may be extended to any arbitrary size and shape in all directions.

15. The Digital Filter

Figure 13:
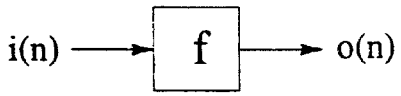
FIGS. 13, 14, 15, 16, 17 and 18 show various filters and their interconnection with delay based elements.

The digital filter is characterized by an input signal i(n) and an output signal o(n) and a method of computing the output signal based on current and past values of the input signal and past values of the output signal. See FIG. 13. The computation of the digital filter is defined algebraically as follows:

$$o(n)=\Sigma_k\, a_k\, i(n-k)-\Sigma_j\, b_j\, o(n-j),$$

where k counts from 0 to K and j counts from 1 to J.

Equivalently we may write, $$o(n)=a_0\, i(n)+a_1\, i(n-1)+\ldots+a_K\, i\,(n-K)-[b_1\, o(n-1)+b_2\, o(n-2)+\ldots+b_J\, o\,(n-J)]$$

The $a_k$ and $b_j$ are the arbitrary constant filter coefficients and K and J together indicate the number of terms in the filter computation. The filter is completely determined by its coefficients.

16. The One-Zero, One-Pole, and One-Zero-One-Pole Filters

The one-zero filter may be characterized by two coefficients, $a_0$ and $a_1$, and the computation method, $o(n)=a_0\, i(n)+a_1\, i(n-1)$. In a simple case, we may take $a_0=0.5$ and $a_1=0.5$ to form a lowpass one-zero filter. The one-pole filter may be characterized by two coefficients, $a_0$ and $b_1$, and the computation method, $o(n)=a_0 i(n)-b_1 o(n-1)$. In a simple case, we may take $a_0=0.5$ and $b_1=-0.5$ to form a lowpass one-pole filter. The one-zero-one-pole filter may be characterized by three coefficients, $a_0$, $a_1$, and $b_1$, and the computation method, $o(n)=a_0 i(n)+a_1 i(n-1)-b_1 o(n-1)$. In a simple case, we may take $a_0=0.5$, $a_1=0.5$, and $b_1=-0.5$ to form a highpass one-pole filter. To form an allpass One-Zero-One-Pole Filter we might chose $a_0=0.5$, $a_1=1$, and $b_1=-0.5$.

17. The Ideal Reflection Filter

The Ideal Reflection filter is defined by the following difference equation: $o(n)=-i(n)$. This is equivalent to using a One-Zero filter with $a_0=-1$, and $a_1=0$.

18. The Introduction of a Digital Filter into a Delay Line

Figure 14:
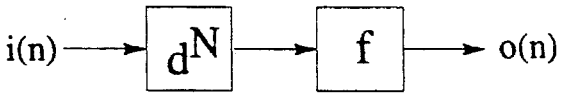

In this case, the output of the delay line is computed and placed at the input of the filter. Then the filter is computed from this current value and its past inputs and outputs. Whether the filter comes before or after the delay unit is arbitrary due to the commutativity of linear systems. See FIG. 14.

19. The Filtered Waveguide

Figure 15:
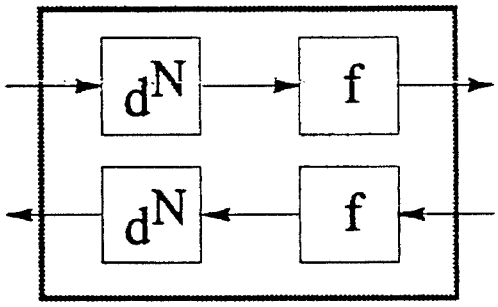

The Filtered Waveguide may be constructed from two filtered bi-directional delay lines, just as the un-filtered waveguide is constructed from two un-filtered delay lines. The filters in the right and left going delay lines need not be the same; and, a filter may only be present in one of the delay lines. FIG. 15 shows a Filtered Waveguide viewed as two Filtered Delay Lines.

Figure 16:
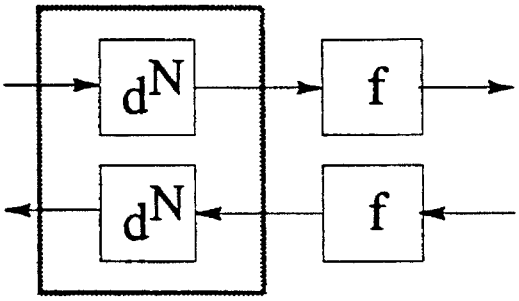

Equivalently, the Filtered Waveguide may be constructed from an un-filtered Waveguide by adding filters at any or all of the input and outputs. Then the computation of this group of elements is to be consolidated into one computation cycle for the whole resulting Filtered Waveguide. FIG. 16 shows a Filtered Waveguide viewed as a Waveguide with Filters at the right side port.

20. The Filtered Scattering Junction

The Filtered Scattering Junction may be constructed in a way similar to the filtered Waveguide. Filters may be placed at any or all of the inputs or outputs of the Scattering Junction. The whole group may be considered and computed together as a Filtered Scattering Junction.

Also, in the internal computation of the junctions, at Step 1, when $v_J$ is performed, the $v_J$ value may be put through a Digital Filter before the Step 2 computation is completed. A Filter may be placed at any point in the computation, whereby the value at that point in the computation is placed at the input of a filter, the output of the filter computed and the old computation value replaced by the output of that filter; the junction computation is then continued.

Figure 17:
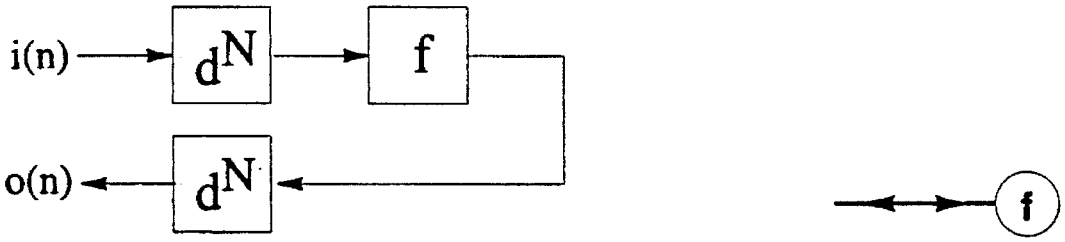

21. Terminating a Waveguide with a Digital Filter In FIG. 17, the output of the right-going delay line is computed from the input, i(n), and presented to the input of the filter; then the output of the filter is computed from this input and its past inputs and outputs; the filter output is presented to the input of the left-going delay line for computation of the output signal o(n). FIG. 17 also shows the short hand schematic representation.

22. Terminating a Waveguide with an Ideal Reflection

Figure 18:
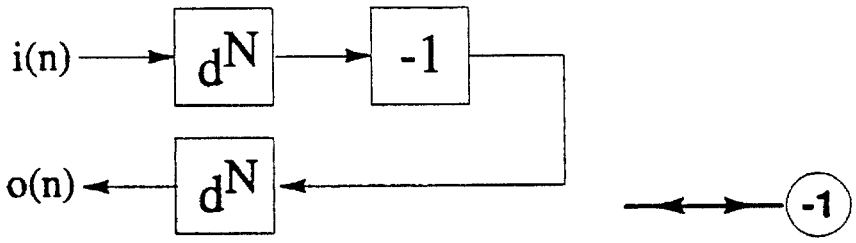

This is a special case of the Waveguide terminated by a digital filter. In this case, the terminating filter is an ideal Reflection filter is defined by the following difference equation: o(n)=−i(n). See FIG. 18.

23. Terminating the 2-D Digital Mesh with Filters

Figure 19:
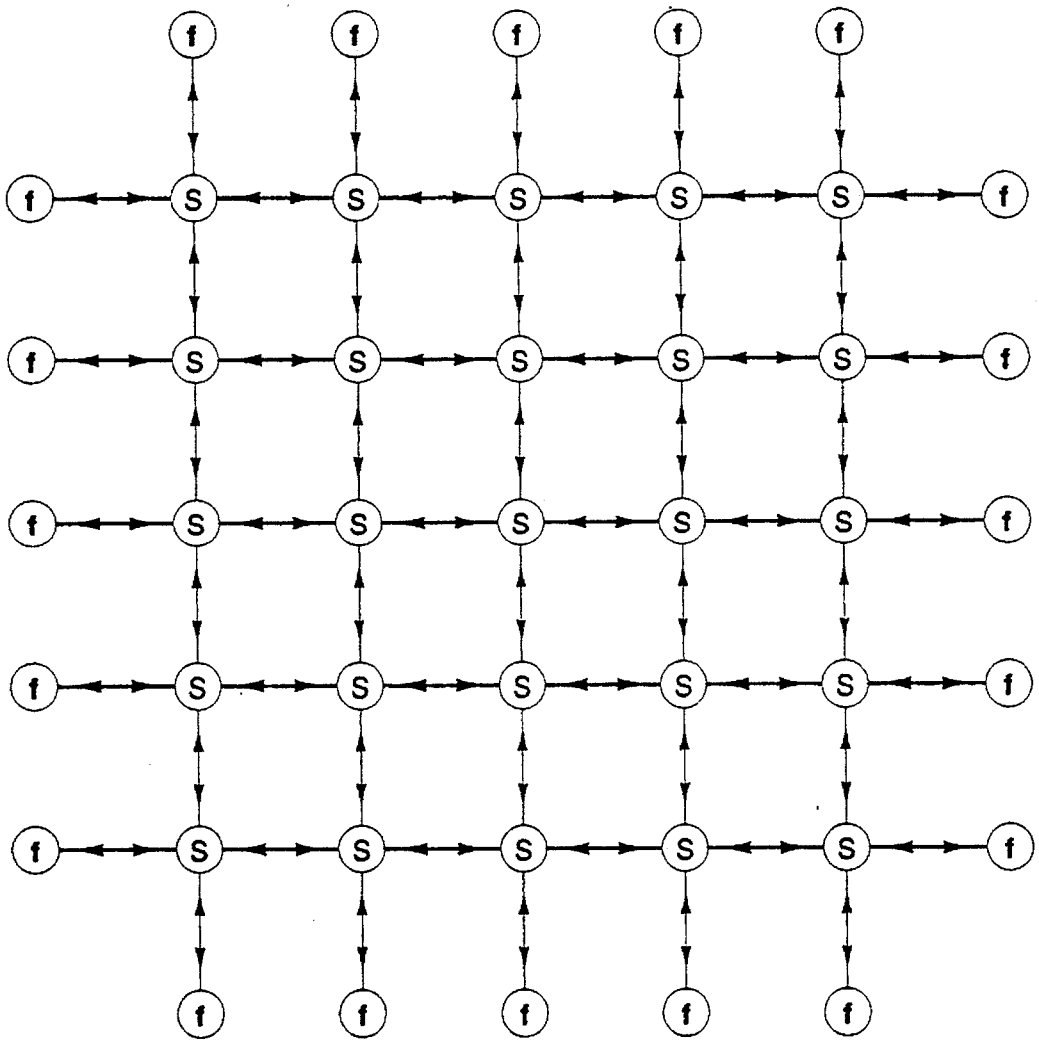
FIGS. 19, 20, and 21 show various methods of terminating the boundary of the mesh.

In this construction, the outer boundary of the mesh consists of Waveguides terminated by Digital Filters. See FIG. 19.

24. Terminating the 2-D Digital Mesh with Ideal Reflections

Figure 20:
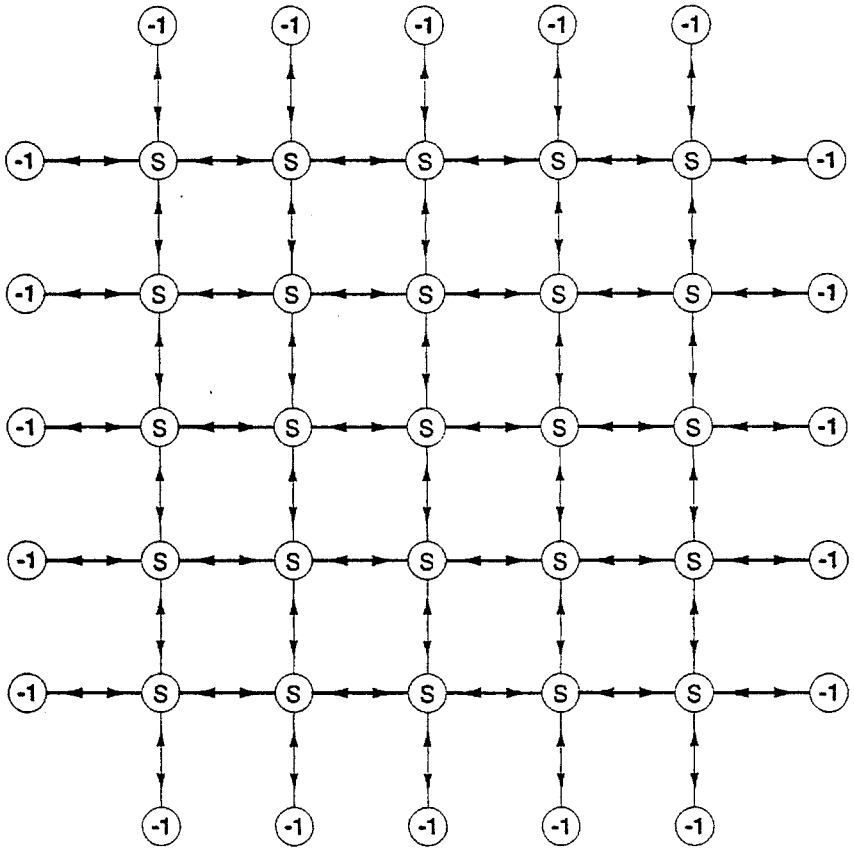

This is a special case of the 2-D Digital Waveguide Mesh terminated with filters, except here the filters are Ideal Reflection filters. See FIG. 20.

25. Terminating the Mesh with 2- and 3-Port Scattering Junctions

Figure 21:
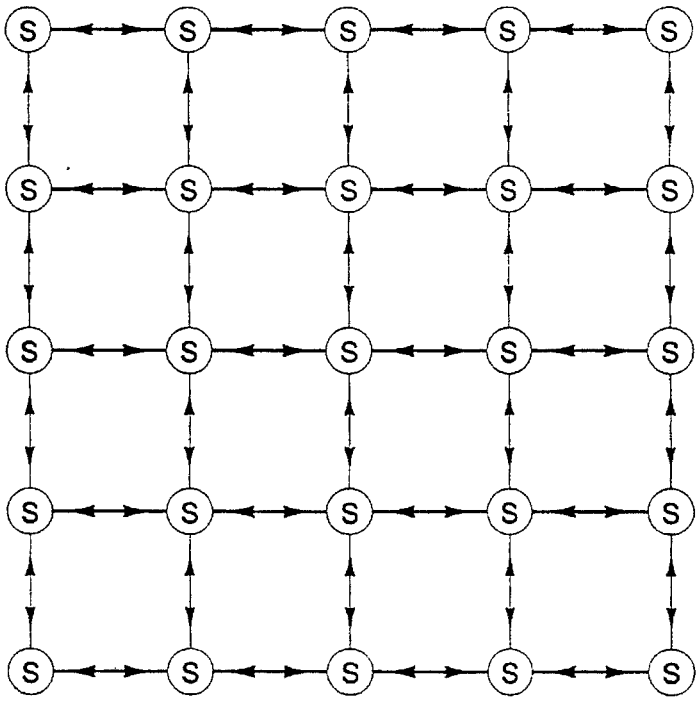

An alternative method of bounding the mesh is to replace the outermost 4-port Scattering Junctions with 2- and 3-port Scattering Junctions such that no Waveguides require further termination beyond these Junctions. In FIG. 21, the scattering junctions are considered to be 2-, 3-, or 4-port as indicated by the number of connections to waveguide elements. The 2-, and 3-port boundary junctions may be replaced with Filtered Scattering Junctions to model some behavior at the boundary of the mesh.

26. Computability of the Mesh

The network Elements in the 2-D Digital Waveguide Mesh fall into two classes: (1) Junction Elements, including Scattering Junctions and Waveguide Termination Filters and (2) Delay elements, including Waveguides and Bi-Directional Unit Delays. In a properly constructed mesh, as described above, computation of each Junction element does not depend on any other element, if the inputs are known. Similarly computation of the Delay elements does not depend on any other element, if the inputs are known. The inputs of the Delay elements are dependent on the outputs of the adjacent Junctions only, and the inputs of the Junctions are dependent on the outputs of the adjacent Delay elements only. The computation cycle may, therefore, be divided into two phases, (1) the Junction computation phase and (2) the Delay computation phase:

Phase 1:Junction Computation

We assume that all the inputs to all the Junctions in the mesh network are known. The outputs of the junctions may therefore be computed for each junction directly from them. The order in which each Junction is computed is arbitrary. After this computation, all the outputs of the Junctions are determined.

Phase 2: Delay Computation

After Phase 1, all the outputs of the Junctions are known. These outputs are coincident with the appropriate Delay Element inputs, so that all the inputs to all the Delay Elements are known. Therefore, the Delays may be computed and all the outputs of the Delay Elements determined. This delay computation represents the time increment of one sample to all the signals entering, exiting, and running through the mesh network. During this phase the time index n is incremented to n+1.

Return to Phase 1

After the completion of Phase 2, all the outputs of all the delay elements are known. Since these are coincident with the appropriate inputs on adjacent Junctions, all the inputs of all the Junctions are known. The computation cycle may therefore proceed to Phase 1. The completion of these two phases represents the passing of one time sample. The mesh will have accepted one sample value from each of any inputs it may have, and each of the outputs of the mesh will have generated one sample value.

27. Implementation on a Parallel Computing Architecture

Due to the arbitrary ordering of the Junction computations and the arbitrary ordering of the Delay computations, implementation on parallel computing machine with local four sided connectivity of processing units is ideal for the mesh algorithm. In this implementation, the junctions are computed in the processing units; and then the data transfer cycle is used to transfer data from the outputs of each processing unit to the inputs of the adjacent processing units. This data transfer constitutes the unit delay of the Bi-Directional Unit Delay elements.

In a parallel VLSI implementation, the no-multiply Scattering junctions may be implemented in hardware with a small number of simple gates. The Bi-Directional Unit Delays may be implemented with specialized delay circuits 28. Introduction of Loss and Dispersion into the Mesh Energy loss and frequency dispersion characteristics may be introduced anywhere into the mesh by replacing a Waveguide with a Filtered Waveguide, or a Scattering Junction with a Filtered Scattering Junction.

29. Summary Filters at the Mesh Boundaries to Model Loss and Dispersion

To simplify computation of the mesh equations, loss and dispersion filters may be summarized at the boundaries of the mesh in the termination filters or in filtered Scattering Junctions at the boundary; or they may be placed at localized points anywhere in the interior of the mesh.

30. Initial Condition Excitation Methods of the Mesh

One method of initializing the mesh is to place random numbers at all the inputs of the Scattering Junctions and Termination filters. Since all the inputs are therefore known to these junctions, computation of the Mesh may begin in Phase 1. Alternatively, random numbers may be placed at all the outputs of the Scattering Junctions (or equivalently at all the inputs of the Delay Elements, and computation may begin in Phase 2 of the computation cycle. We give the example of random excitation to model a high energy excitation; however, specific numbers may be determined to model some specific physical condition. This method of excitation corresponds to the Karplus-Strong random excitation of a String, modeling random initial displacements and random initial velocities at all points on the String. In the Mesh case, it models random initial displacements, random initial velocities, and random initial directions of wave propagation.

Figure 1:
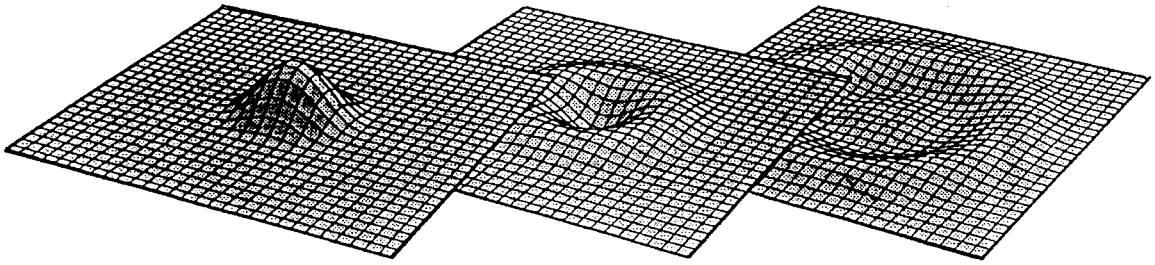
FIG. 1 shows three graphical snapshots of wave propagation in the 2-D Digital Waveguide Mesh excited by an initial deflection.

An alternative method of excitation would be to compute one random number for each junction and to assign this number to each of the inputs of that junction. This method requires, in general, about one fourth the number of random numbers to be generated. This excitation method models an initial displacement of the mesh (membrane). It corresponds to the initial pluck shape of a 1-D Waveguide string model. One may also choose specific initialization values to model a specific displacement of the mesh membrane model. FIG. 1 shows the time evolution of a mesh with a particular initial deflection shape.

An other alternative is to choose inputs to all the Scattering junctions in such a way that the $v_J$'s at all points sum to zero, but all or some of the inputs are non-zero. This method of excitation corresponds to an initial strike to the membrane, and corresponds to a struck string in the 1-D case.

31. Driving the Mesh with an Input Signal

Figure 22:
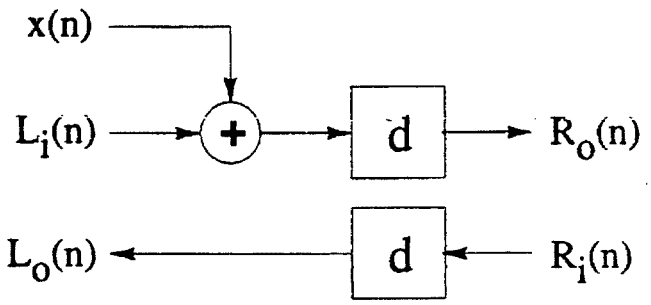
FIGS. 22, 23, and 24 show methods of summing a driving signal into the mesh.

In addition to initializing the mesh with values, or instead of it, the mesh may be driven by an input signal from an external source or from some internal source. In this situation the incoming signal is summed to any value anywhere in the mesh. For example the incoming signal may be summed into a Bi-Directional Unit Delay element, as shown in FIG. 22. In this diagram, the input signal is indicated by x(n). The signal x(n) is to be added to the left input of the Bi-Directional Unit Delay before the right output is computed, i.e., $R_o(n)=L_i(n-1)+x(n-1)$.

Figure 23:
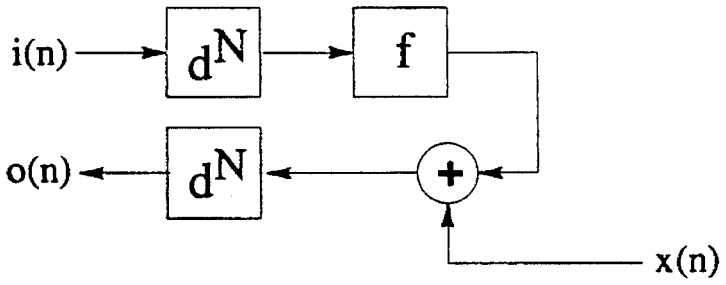

As an other example, an input signal may be summed into a termination filter as shown in FIG. 23. Here the output of filter, f, is added to the input signal x(n) before it is placed at the input the the left-going unit delay.

In general, an input signal may be summed into any point anywhere on the mesh which is algebraically possible.

32. Individual Output Signals from the Mesh

An output signal from the mesh may be obtained by reading the value at any point of the mesh. At each cycle of computation this value will be updated and these values will constitute the outgoing signal. In general this output may be taken from any point anywhere on the mesh or inside of its computational algorithms.

In practice, one may choose, for example, to monitor the values of $v_J$ at one Scattering Junction. The output signal obtained from these values would correspond to the velocities, displacements, pressures, etc. seen by an observer situated at that point.

33. Summary Output Signals from the Mesh

Any combination of individual output signals may be scaled and summed to form a summary output signal from the mesh. Summing all $v_J$'s in a region of the mesh models the total sound pressure heard by an observer at a distance far from the mesh.

34. Schematic to Show Arbitrary Input and Output from Mesh

Figure 24:
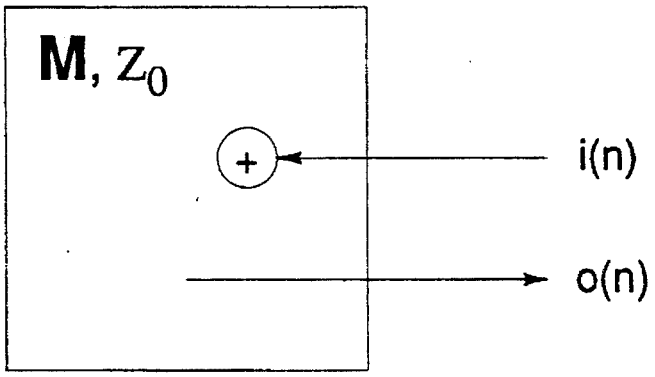

In FIG. 24, the circumscribed plus sign (+) is understood to indicate summing the input signal, i(n), into any arbitrary point of computation in the mesh. The output signal o(n) is understood to be taken from any arbitrary point or temporary value which occurs in the mesh computation. The box marked M represents an arbitrary 2-D mesh. $Z_0$ indicates the mesh is constructed using Bi-Directional Unit Delays with wave impedances equal to $Z_0$.

35. Ports to the Mesh

Instead of, or in addition to, driving the mesh with inputs and extracting output signals by monitoring values in the mesh computation, another method of communication with the mesh may be constructed through a port; A port is defined above as an input-output pair of any network element.

Figure 25:
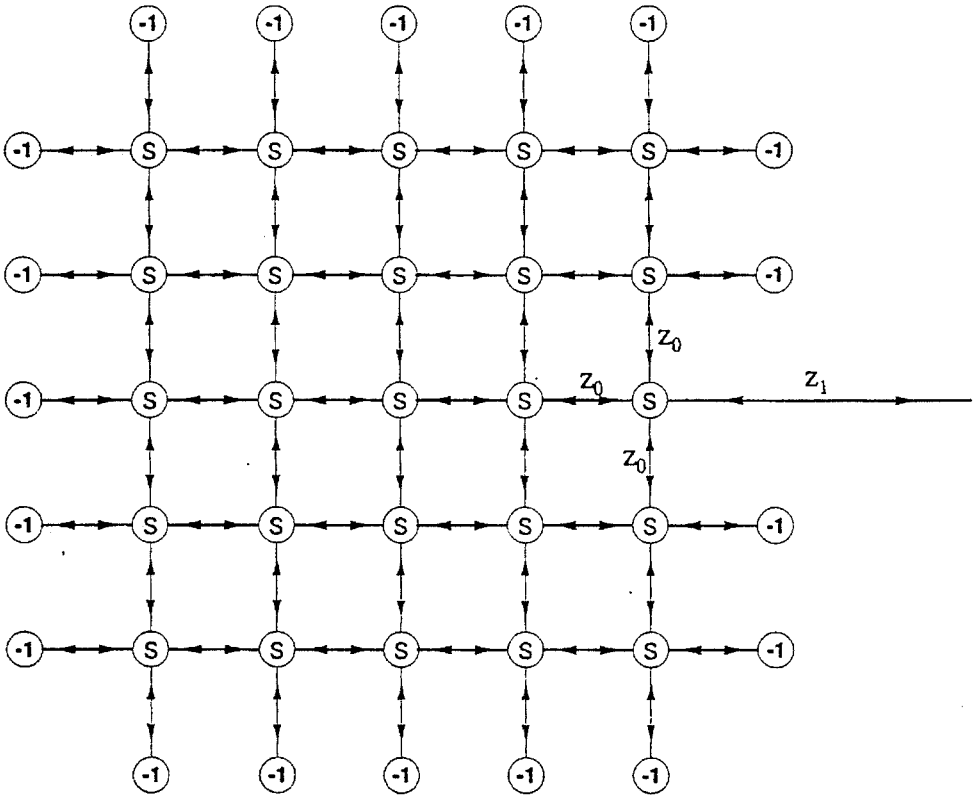
FIGS. 25, 26, 27, 28, and 29 show methods of connecting to and between network elements via ports.
Figure 26:
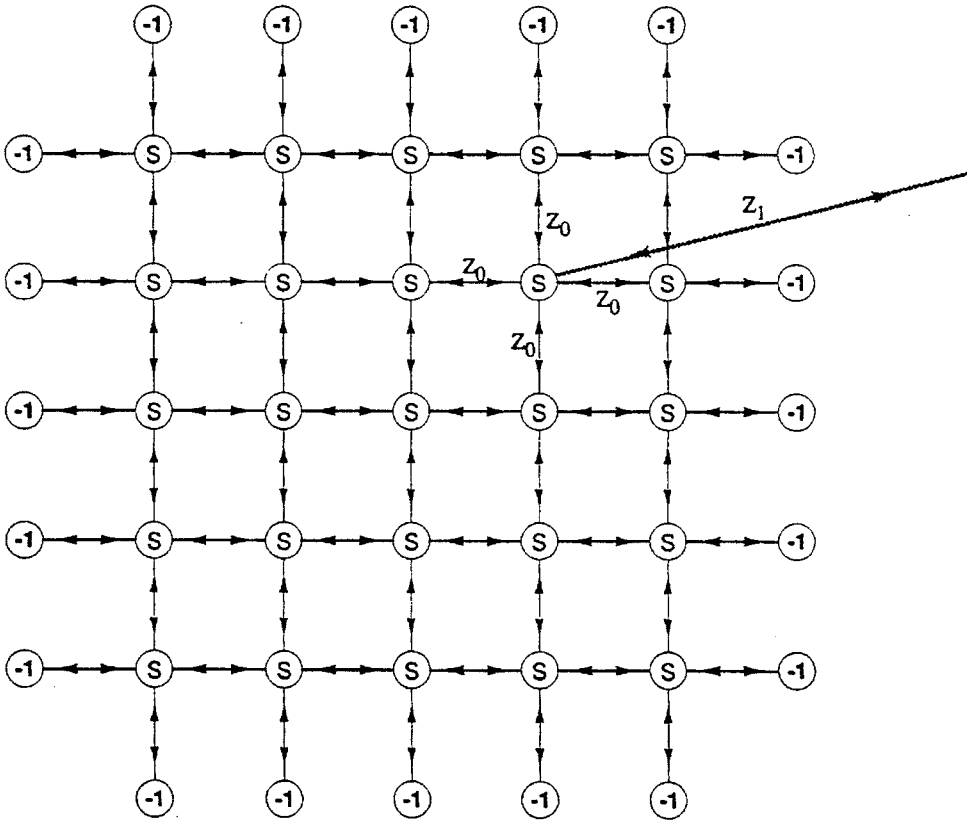

In FIGS. 25 and 26, Digital Waveguides are connected to 4- and 5-port Scattering Junctions in the mesh, respectively. In each case the left-going wave in the Waveguide is the input to the mesh and the right-going wave is the output signal from the mesh. In each case the wave impedance of the connecting waveguide is not necessarily the same as that of the the Waveguides inside the mesh. The relationship of the wave impedances at the connecting Scattering Junction determines the amount of input signal being absorbed by the mesh, the amount of output signal being returned to the connecting Waveguide from the mesh, and the amount of input signal being reflected back from the input signal into the output signal directly.

Figure 27:
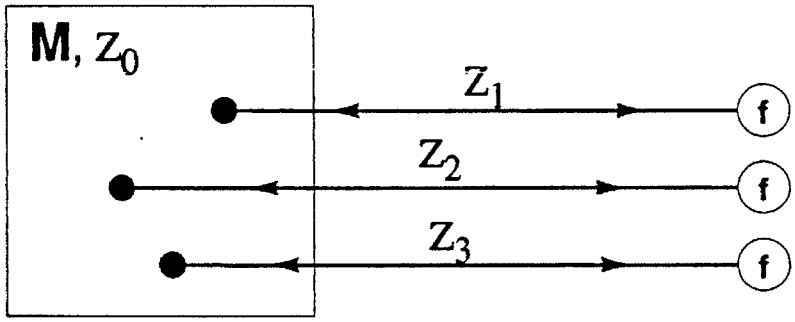

FIG. 27 shows a schematic view of a mesh, M, with Bi-Direction Unit Delay wave impedances, $Z_0$, connected via 5-port Scattering Junctions (indicated by the three large filled dots), to three Waveguides with wave impedances, $Z_1$, $Z_2$, and $Z_3$, respectively, terminated by reflection filters, f.

36. Interconnection of the Mesh to other Physical Model Elements

Figure 28:
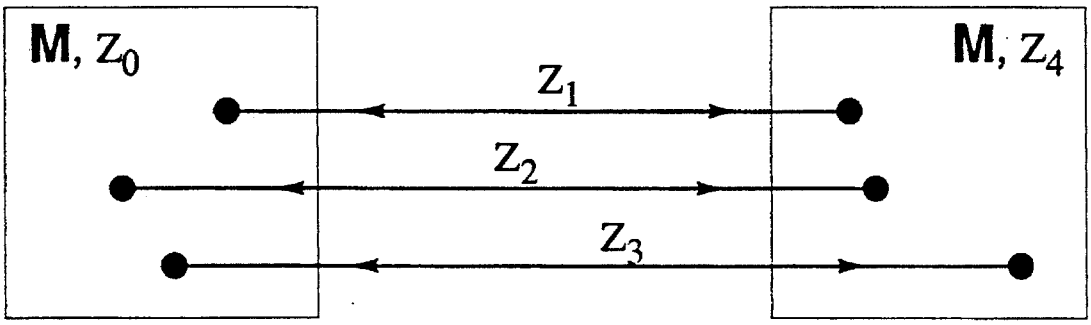
Figure 29:
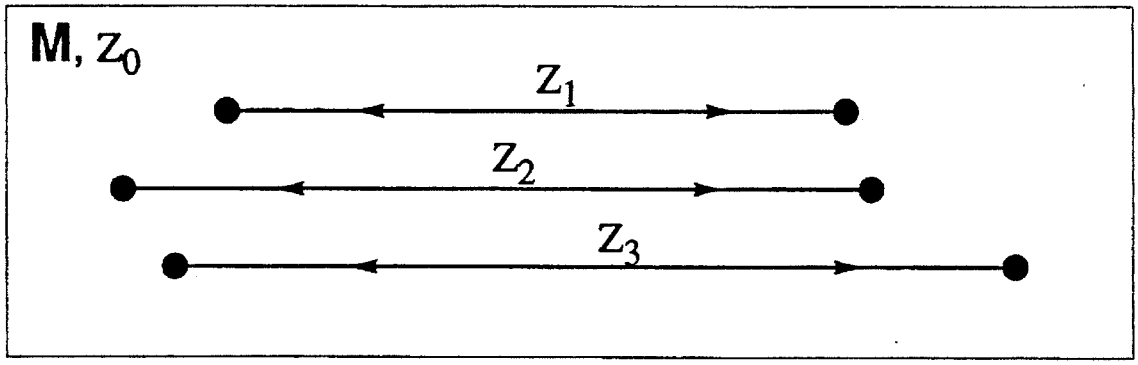

The interconnection of a mesh to another network element is, in general, made through ports as described in Section 35. A mesh may be connected to a variety of Waveguides as in FIG. 27, or one mesh may be connected to another mesh (FIG. 28), or to itself via waveguides (FIG. 29).

In this last example (FIG. 29), the connecting Waveguides are considered to lie outside of the Mesh network proper, and only touch the mesh at the six 5-port Scattering Junctions marked with the large dots.

37. The Square Drum Head

The Drum Head may be modeled as a membrane which is clamped down at the rim. In the case of the Square Drum, a square Mesh is constructed of arbitrary size. The Mesh is terminated by Bi-Directional Unit Delays Terminated with Digital Filters. The terminating filters should be lowpass in characteristic. For example, they may be One-Pole filters as described above with a0=0.5 and b1=0.5.

Figure 30:
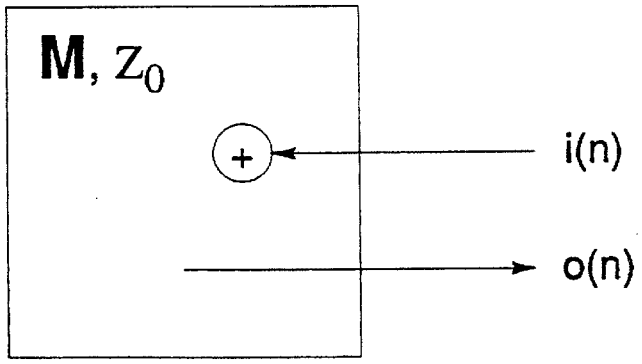
FIGS. 30, 31, 34, 35, 36, 37 and 38 show various acoustic models using the 2-D mesh.

The Square Drum Head is shown schematically in FIG. 30. The mesh is driven by an input signal i(n) which models the mallet strike on a membrane. This input signal may be quite various. For example, a noise burst may be used. In this case i(n) would consist or a sequence of random numbers for a designated number of samples, followed by all zeros for the rest of time.

An alternative way to initiate the Drum is to fill all the values with random numbers and to remove the input signal all together, as described above in Section 30: Initial Condition Excitation Methods of the Mesh. A combination of initial excitation and driving input signal may be used.

38. The Metal Plate

Figure 31:
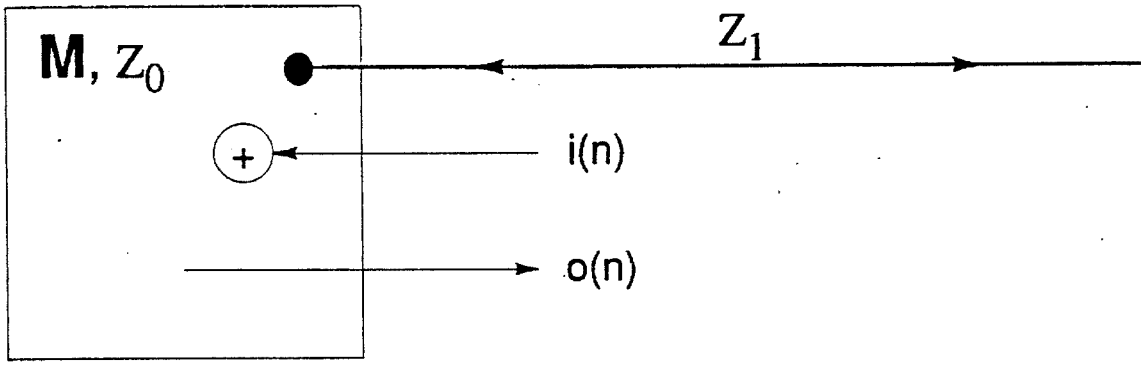

The Metal plate is similar to the Square Drum except that the terminating filters should be adjusted to allow more high frequencies through. For example the One-Zero filter described above with a0=0.5 and a1=0.5 may be used. In the Metal Plate, it may be desirable to drive the mesh with an input signal as in the Drum, or to drive it through a port. The termination filters of the Plate may include some all-pass characteristics which introduce dispersion into the mesh. This models the stiffness of the plate. FIG. 31 shows the plate model driven by an input signal or by a port connection.

39. The Non-Linearity

Figure 32:
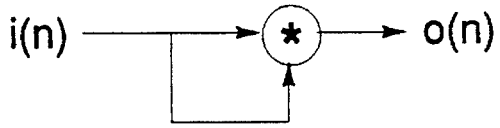
FIGS. 32 and 33 show possible methods of injecting non-linearity into the network.

A non-linearity is characterized by a combination or mutation of a signal or several signals in a way which does not preserve the linearity of operation on them. In a simple case, as FIG. 32 shows, o(n) may be computed from i(n) as follows: $o(n)=i(n)^2$. The circumscribed asterisk indicates a multiplication operation.

Another form of non-linearity is the Look-up Table in which an input value indexes an arbitrary table and the output is read directly from the table at that index. Many other forms of non-linearity exist. The essential characteristic of the non-linearity is that the signals are combined or mutated in some way other than the scaling by a constant or the adding together of several signals.

40. Introduction of the Non-Linearity into the Mesh

Figure 33:
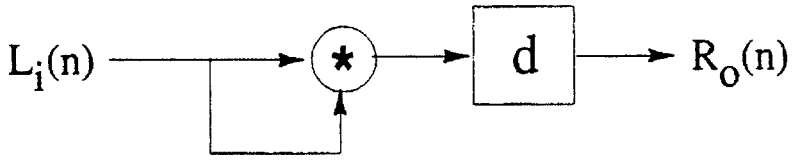

The diagram in FIG. 33 shows the introduction of a non-linearity into a unit delay. The output $R_o$ is computed from the input Li as follows: $R_o(n)=L_i(n-1)^2$.

A non-linearity may be introduced into the mesh at any point where an algebraic calculation is taking place. The value at any point may be passed through a non-linearity and the old value replaced by the new value before computation continues.

41. The Gong

Figure 34:
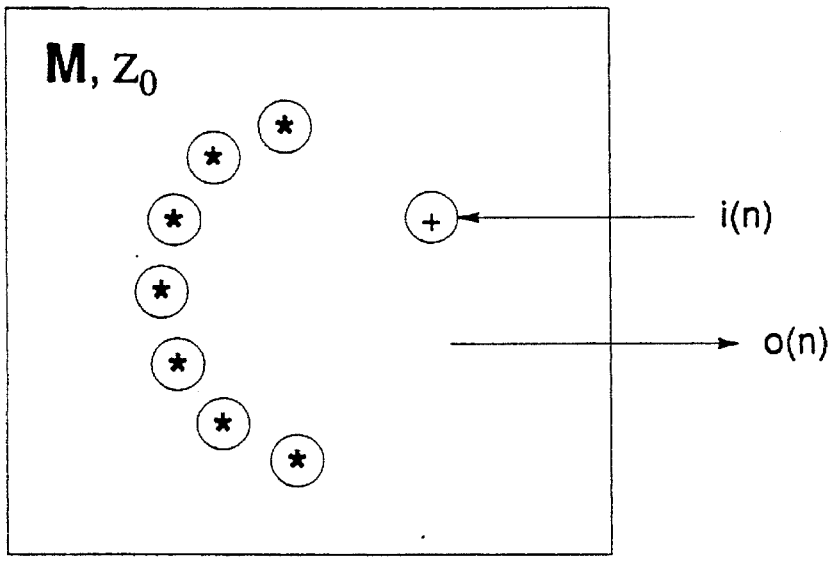

The Gong is similar to the metal plate except that non-linearities are introduced into the mesh at a variety of points marked with a circumscribed asterisk (*). (See FIG. 34.) These non-linearities affect the frequency evolution in the mesh by introducing new frequency components into the signal.

42. The Sound Board

Figure 35:
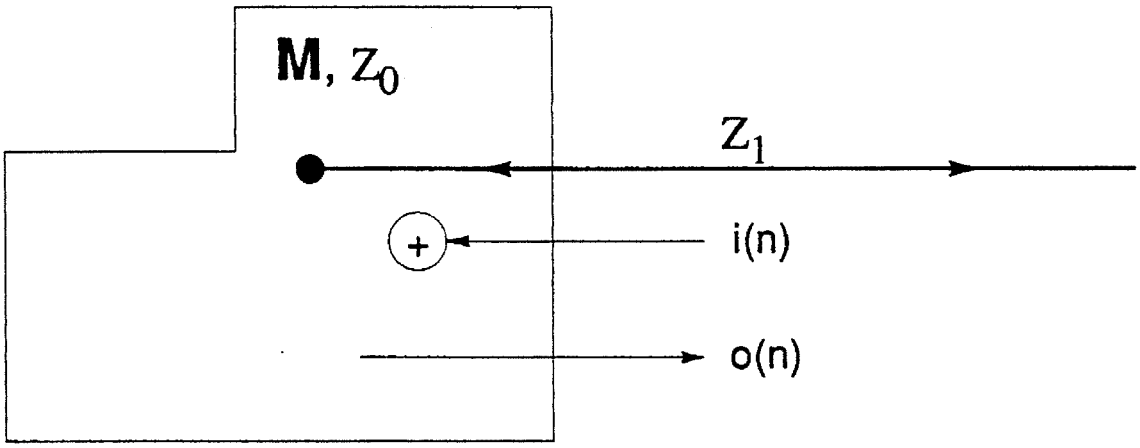

The Sound Board Model shown in FIG. 35 is designed to provide a reverberant environment for signals to mix together and scatter. The sound board may be driven by input signals, or be excited by connections to other network elements via ports. Outputs may be taken from any point as discussed above. The sound board consists of an arbitrarily shaped mesh with reflective terminating filters with a low pass frequency response such as the One-Pole or One-Zero Filter described above. Allpass characteristics may be introduced in the termination filters to model dispersion of the frequencies as in the Metal Plate. The diagram (FIG. 35) shows a sound board which is driven by an input signal i(n) and connected to a waveguide with wave impedance $Z_1$. The output signal o(n) is taken from an arbitrary point in the mesh.

43. The Efficient SoundBoard

Figure 36:
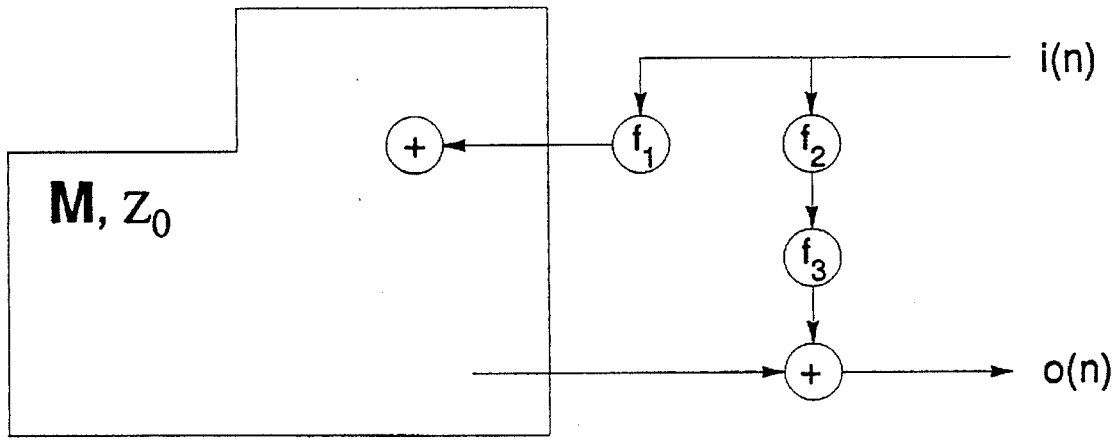

In FIG. 36, $f_1$ is a low pass filter, such as the One-Pole Filter described above, $f_2$ is a high pass filter, such as the One-Zero-One-Pole Filter described above, and $f_3$ is a summary filter or table look-up which models efficiently the high frequency modes of the sound board. The low pass frequencies are injected into the soundboard, and the low frequency output of the sound board is summed to the summary high pass frequencies to form the output signal. The effective mesh sampling rate may be slowed down as required by replacing the Bi-Directional Unit Delays by Waveguides of longer length, or by sampling rate conversion. This method reduces the required size of the mesh, and therefore reduces the overall computational power needed.

44. The 8-String Piano Model

Figure 37:
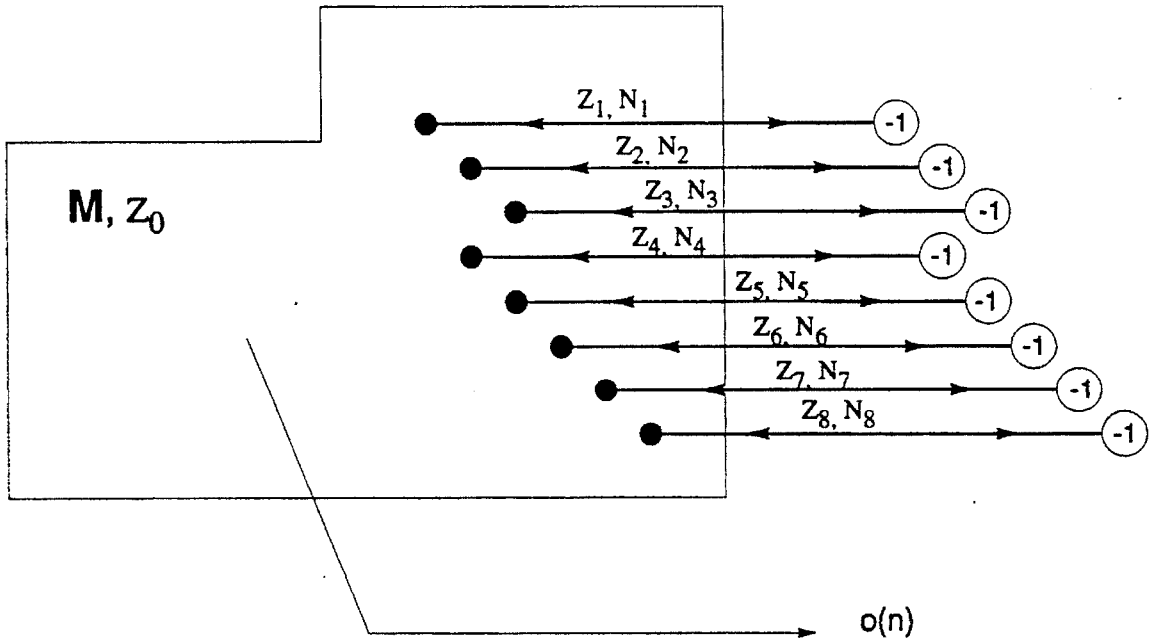

The Piano Model shown in FIG. 37 consists of a Sound Board connected to Waveguide String Models of varying lengths and wave impedances via ports to the mesh. An arbitrary output is taken from the mesh. In the simplest case, the waveguides are terminated with Ideal reflection filters. In the more complex cases, the Waveguides and termination filters may be replaced with arbitrarily complex waveguide based string models. It is understood that excitation of the strings shall be determined by the string model, for example the left- and right-going delay lines of the relevant waveguide may be loaded with an initial deflection shape at time n=0. This energy will then scatter into the mesh and back out into the other string models which are attached to the mesh. This construction evidently models a piano whose string dampers have been raised. To lower the dampers on a particular string, that string Waveguide may be temporarily disconnected from the computation loop, the connecting Junction reduced from a 5-port to a 4-port, and the Waveguide delay line contents zeroed out.

45. The 3-String Harp Model

Figure 38:
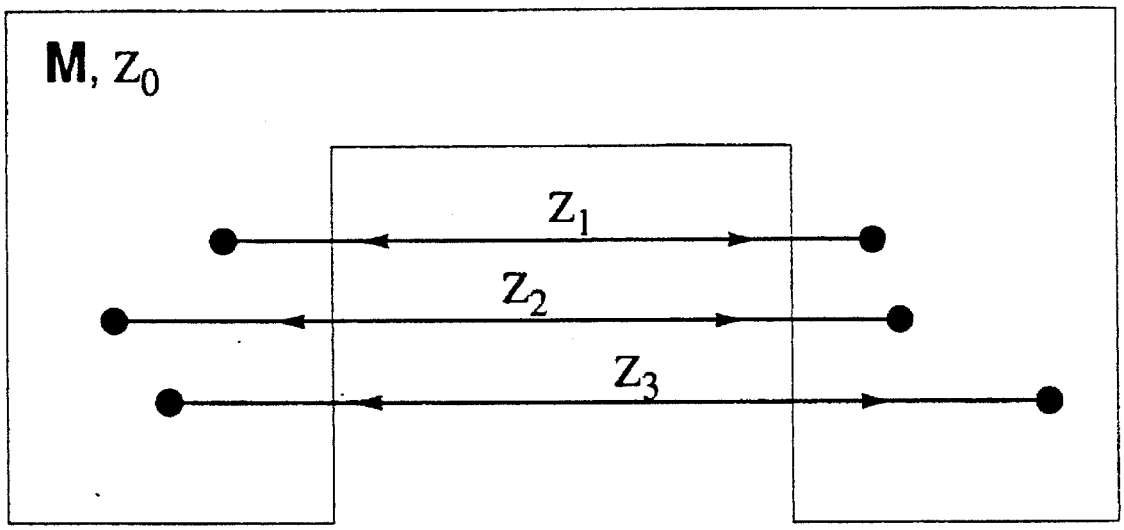

The Harp model shown in FIG. 38 is similar to the piano model except that both ends of the waveguide string models are attached into the mesh.

46. The 3-D Extension

Figure 39:
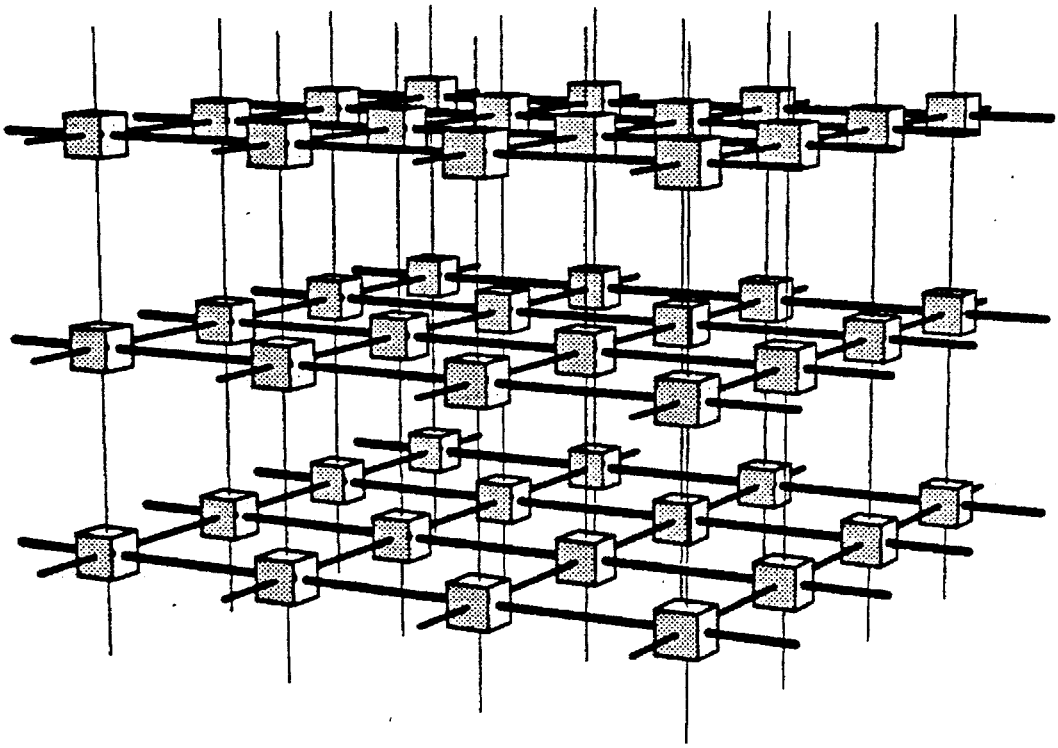
FIG. 39 is a representation of the 3-D Digital Waveguide Mesh.

A three dimensional extension of the Waveguide mesh is constructed by laying 2-D Meshes one above the other and interconnecting adjacent Scattering Junctions with Waveguides. The Scattering Junctions now become 6-port. In FIG. 39, the cubes represent the 6-port Scattering Junctions, and the interconnecting lines represent the Waveguides. A no-multiply version of the 3-D mesh may be created by setting the wave impedances of the vertically oriented Waveguides to be twice the magnitude of the wave impedances of the horizontally oriented Waveguides.

The Waveguide Mesh may evidently be extended into any number of dimensions by a similar process.

47. Alternative Topologies for the Digital Waveguide Mesh

Figure 40:
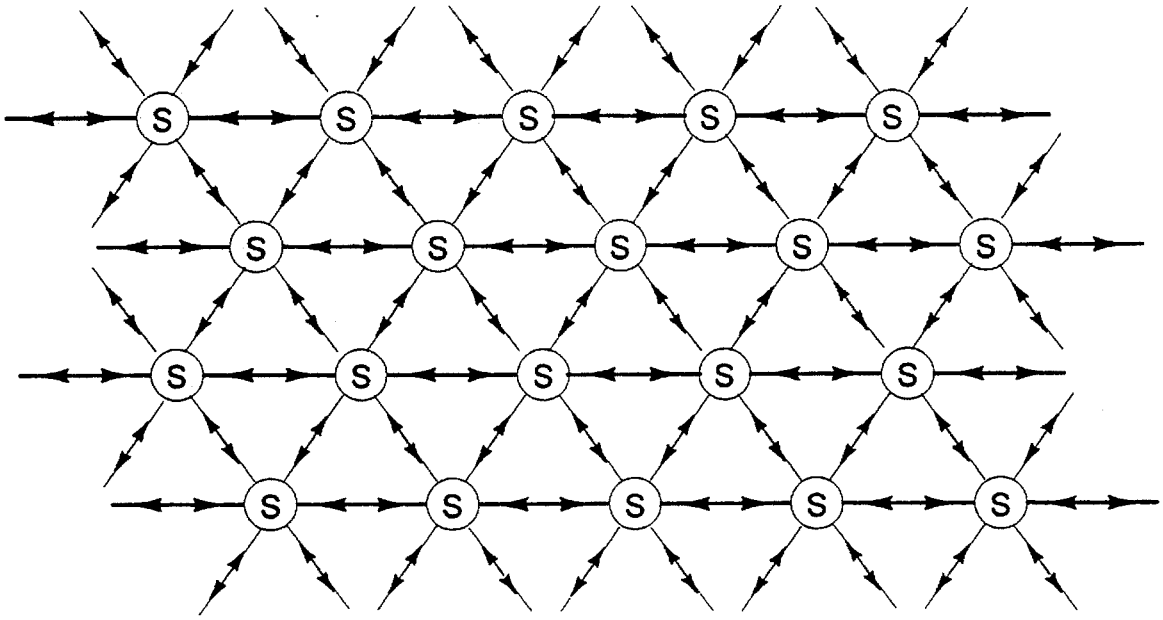
FIGS. 40, 41, 42 and 43 are alternative topological structures for the 2-D mesh.

We have been using a 4-port mesh model. There are many other arrangements which may be seen to be useful. Several examples are given here:

Honeycomb Arrangement of 6-port Scattering Junctions: (See FIG. 40.) In this case all the Scattering Junctions are 6-port.

Figure 41:
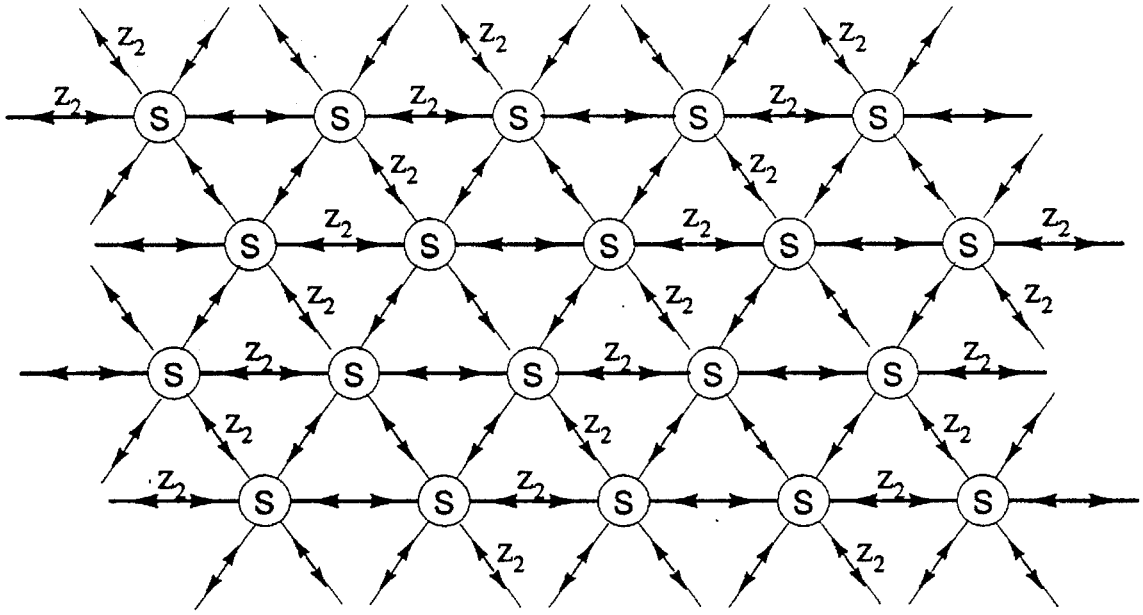

The No-Multiply Honeycomb arrangement with rippled wave impedances: (See FIG. 41.) In this arrangement the unmarked wave impedances are taken to be $Z_1$ and $Z_2=2\,Z_1$. It is easily seen that the computation of $v_J$ in Step 1 of the scattering Junction computation reduces to the form, $v_J=(1/4)(i_1+i_2+i_3+\ i_4+2i_5+2i_6)$. The multiplies by 2 and the divide by 4 may be implemented by sign preserving shifts in a fixed point binary arithmetic. Therefore no multiplies are required in this computation.

Figure 42:
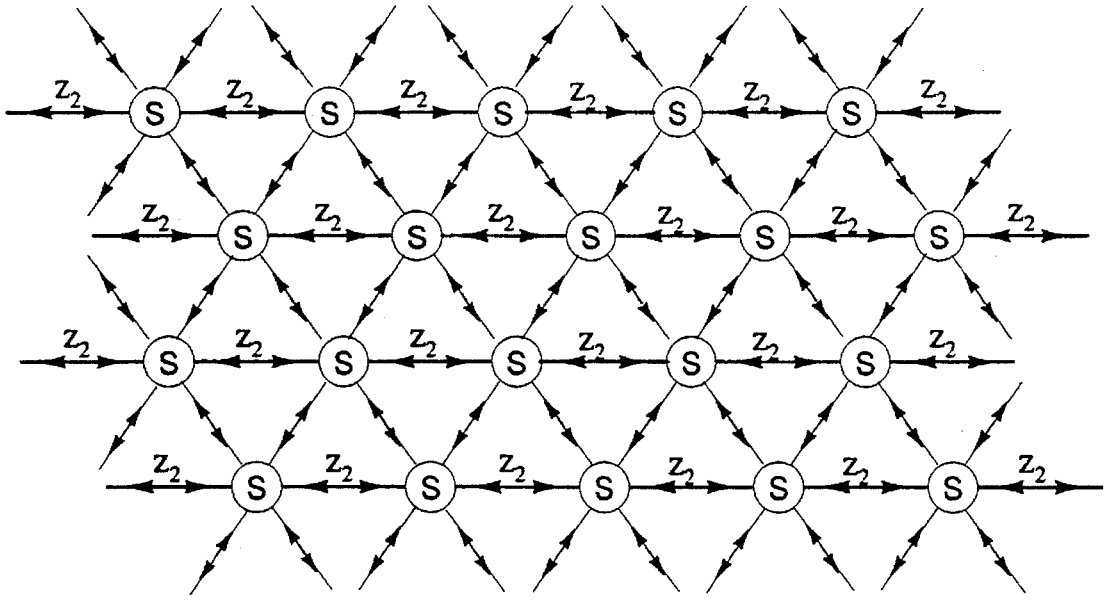

The No-Multiply Honeycomb arrangement with striated wave impedances: (See FIG. 42) In this arrangement the unmarked wave impedances are taken to be $Z_1$ and $Z_2=2\,Z_1$. It is easily seen that the computation of $v_J$ in Step 1 of the scattering Junction computation reduces to the form, $v_J=(1/4)(i_1+i_2+i_3+\ i_4+2i_5+2i_6)$. The multiplies by 2 and the divide by 4 may be implemented by sign preserving shifts in a fixed point binary arithmetic. Therefore no multiplies are required in this computation.

Figure 43:
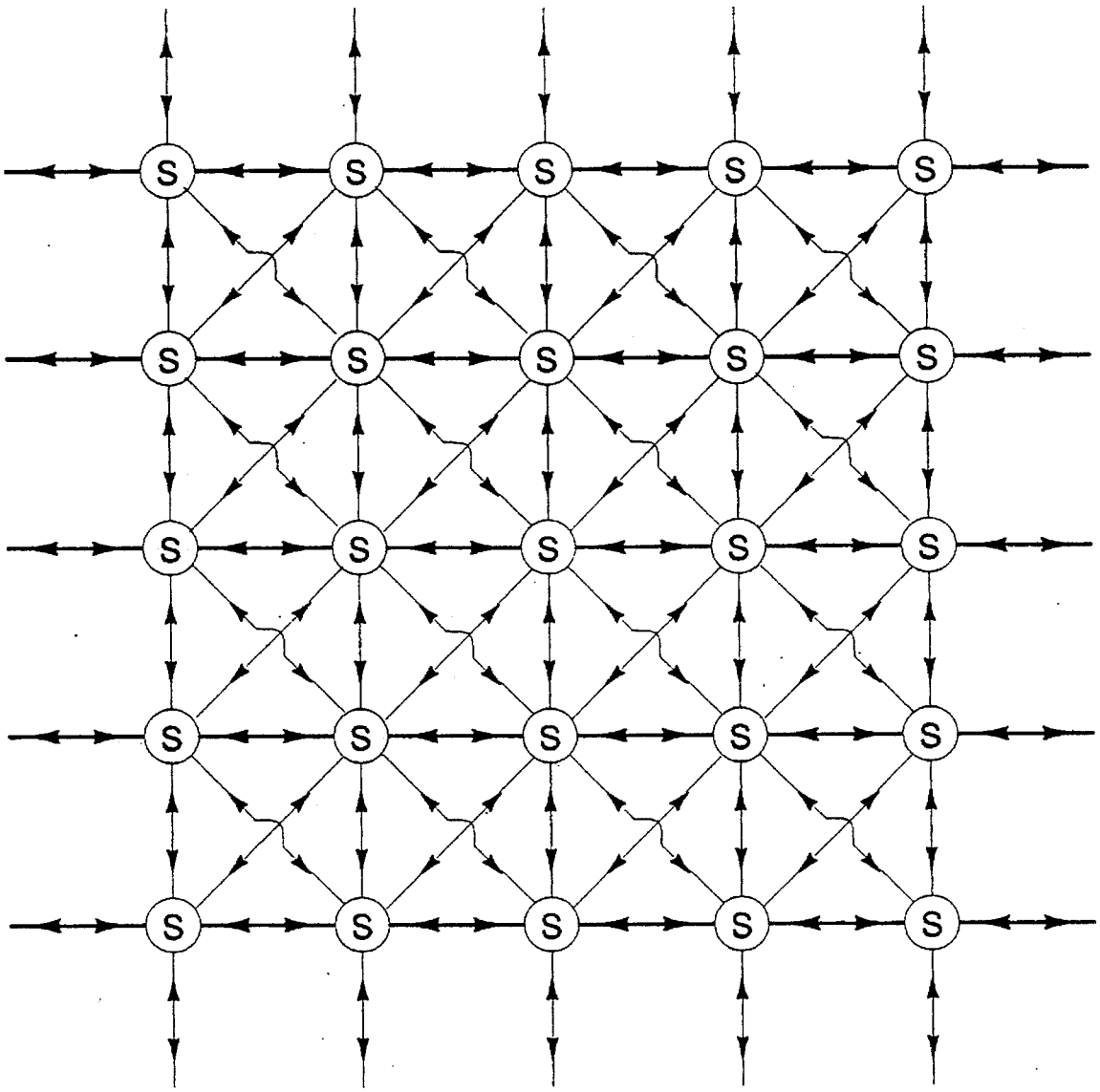

Diagonal criss-cross 8-port layout: (See FIG. 43.) If all the wave impedances are chosen to be equal, the computation of the Scattering Junctions reduces to a no multiply computation.

Stacked 6-port meshes to make no multiply 3-D version: (no figure) Honeycomb arrangement meshes may evidently be stacked one above the other and interconnected by Bi-Directional Unit Delays as the the 4-port case shown above in Section 46. Since the Scattering Junctions are now 8-port, there are no multiplies required in computing an equal impedance mesh.

48. The Cylindrical Shell Mesh Layout

Figure 44:
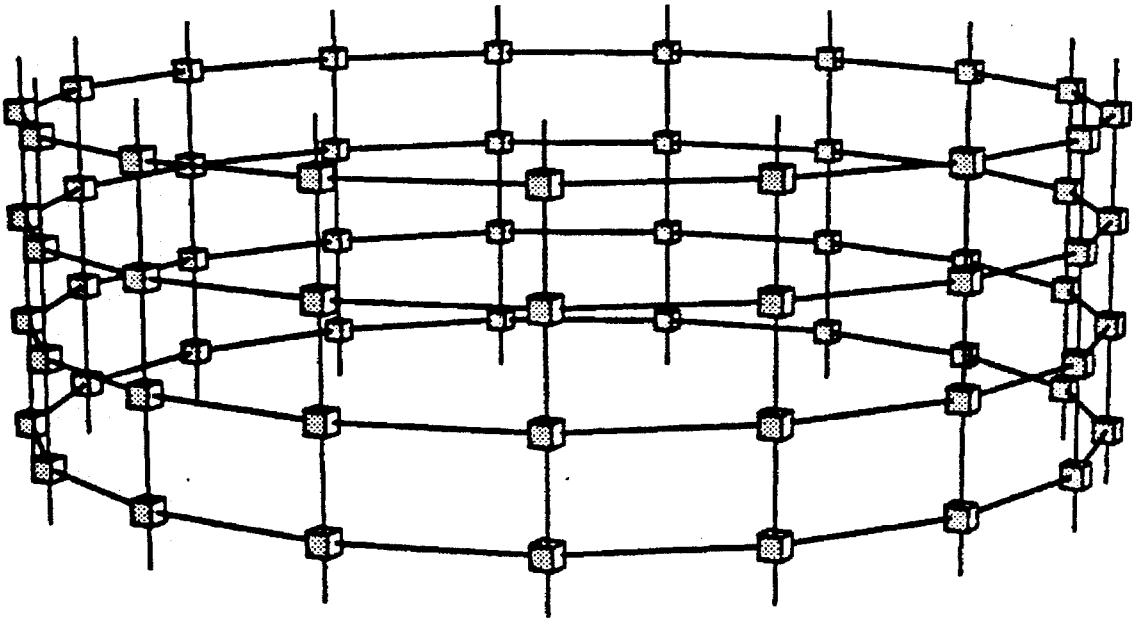
FIGS. 44 and 45 show the cylindrical mesh.

A rectangular Mesh may be connected together on opposite sides to form a cylindrical mesh (see FIG. 44) which may model a cylindrical shell.

49. Cylindrical Mesh Coupled to an Acoustic Tube Model

Figure 45:
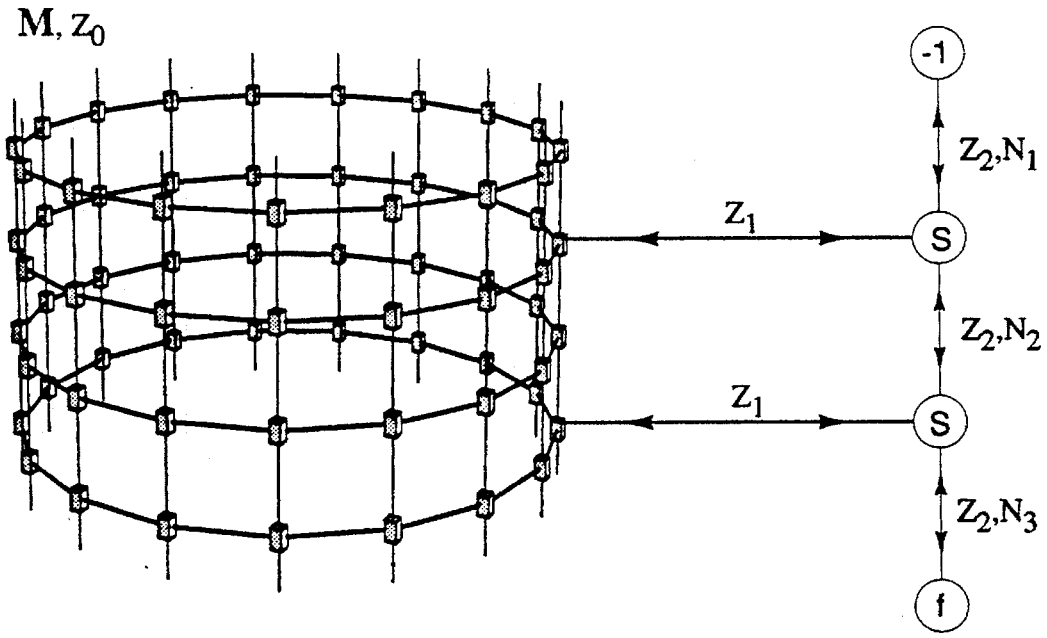

The cylindrical mesh may be used to model the shell surrounding an acoustic tube. In FIG. 45, a cylindrical mesh with wave impedance, $Z_0$, is coupled to an acoustic tube model with wave impedance $Z_2$ via Waveguides with wave impedance $Z_1$ at various points.

50. The Cymbal: A Radial Topology for the Mesh

Figure 46:
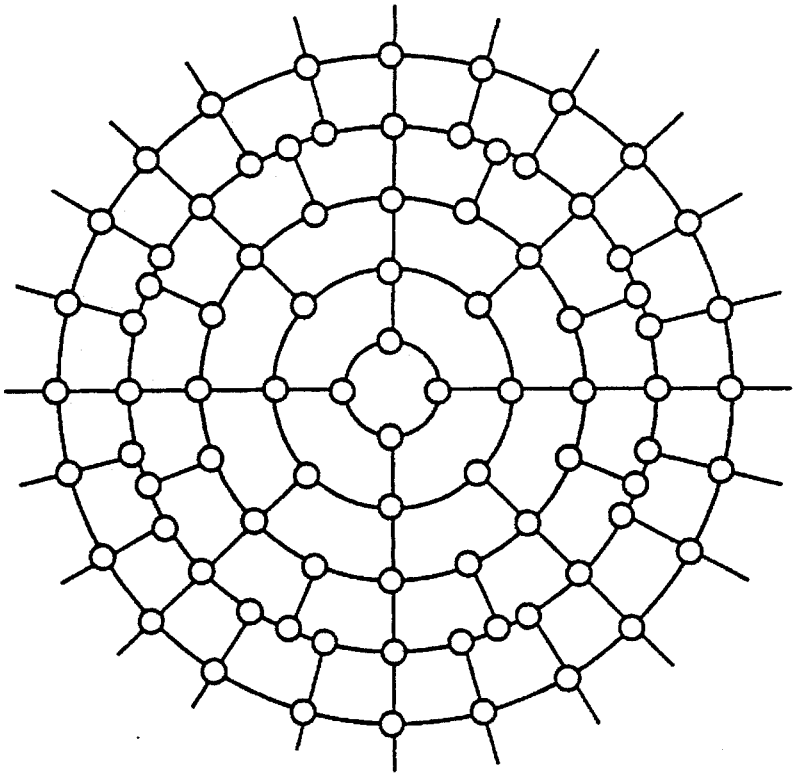
FIG. 46 shows a radial version of the mesh.

Here, an alternative topology is used for the mesh in which the scattering junctions, represented by the small empty circles in FIG. 46, laved are laid out in concentric circles interconnected with Waveguides, shown in the figure as curved or straight line segments, in both the radial and circular directions. The wave impedances may be defined to be smaller in the circular directions and larger in the radial directions to model more facile wave travel in the circular directions. The usual inputs and outputs may be provided for the radial mesh, and the mesh may be terminated at the outer circle in one of the previously described ways.

51. The One String Guitar

Figure 47:
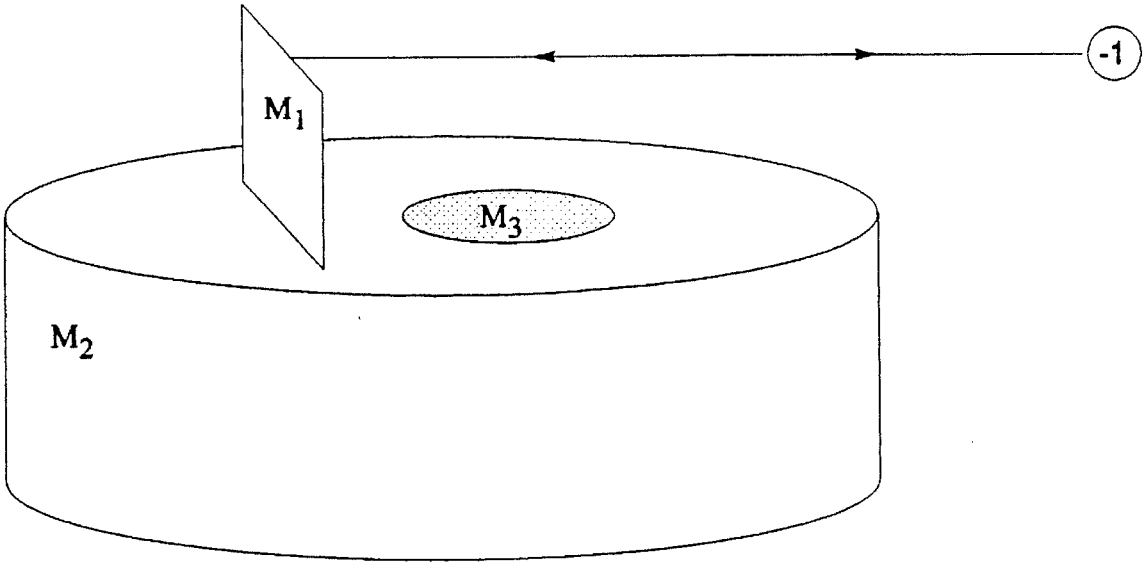
FIGS. 47, 48 and 49 show models of various musical instruments using the 2-D mesh, the 3-D mesh and other network elements.

In FIG. 47, the 2-D mesh marked $M_1$ represents the bridge, $M_2$ represents the guitar body. $M_2$ is constructed by joining a top and bottom 2-D mesh to a cylindrically constructed mesh forming the sides of the body. $M_3$ marks a 3-D mesh inside the guitar body modeling the air spring inside the body.

52. The 3-D Drum Model

Figure 48:
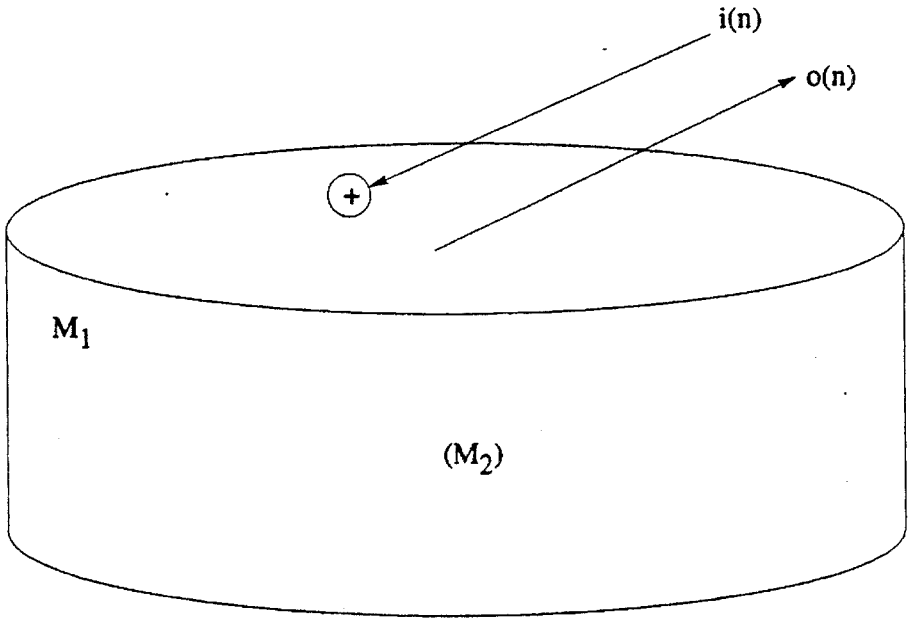

In FIG. 48, the 2-D mesh marked $M_1$ represents the drum body. It is constructed by joining a top and bottom 2-D mesh membrane model to a cylindrically constructed mesh side panel model. $M_2$, indicated in parenthesis, marks a 3-D mesh representing the air spring inside the drum cavity. Input and output signals are marked.

53. The Snare Drum Head Membrane/Spring Model

Figure 49:
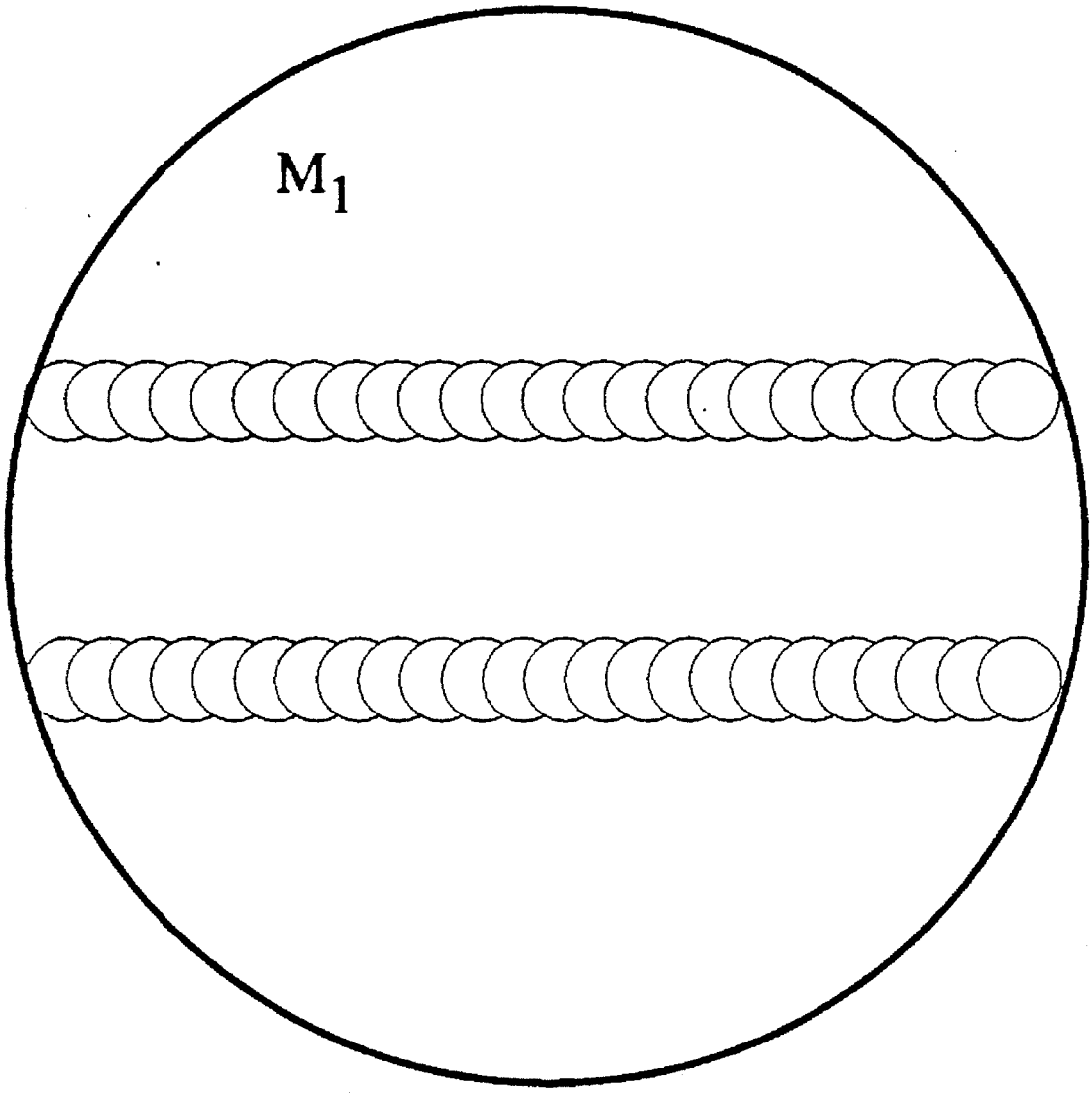

In FIG. 49, the 2-D mesh marked $M_1$ represents the membrane stretched across the drum rim. The two Snare springs shown in the figure are stretched across the membrane and lie initially in contact with the membrane. When the membrane is excited, the springs and the membrane bounce against each other forming many inelastic collisions. The springs are modeled by Waveguides, the membrane with a 2-D Mesh. When it is determined that some point of a spring and the membrane are in contact because their computed displacement values coincide, the spring and membrane are linked together at that point via a non-linear junction computation. These junctions are gated in such a way that where the springs and membrane are not in contact, the signals in each structure are allowed to flow without the non-linear interaction. These points of contact introduce new frequencies into the signals in the network.

Figure 50A:
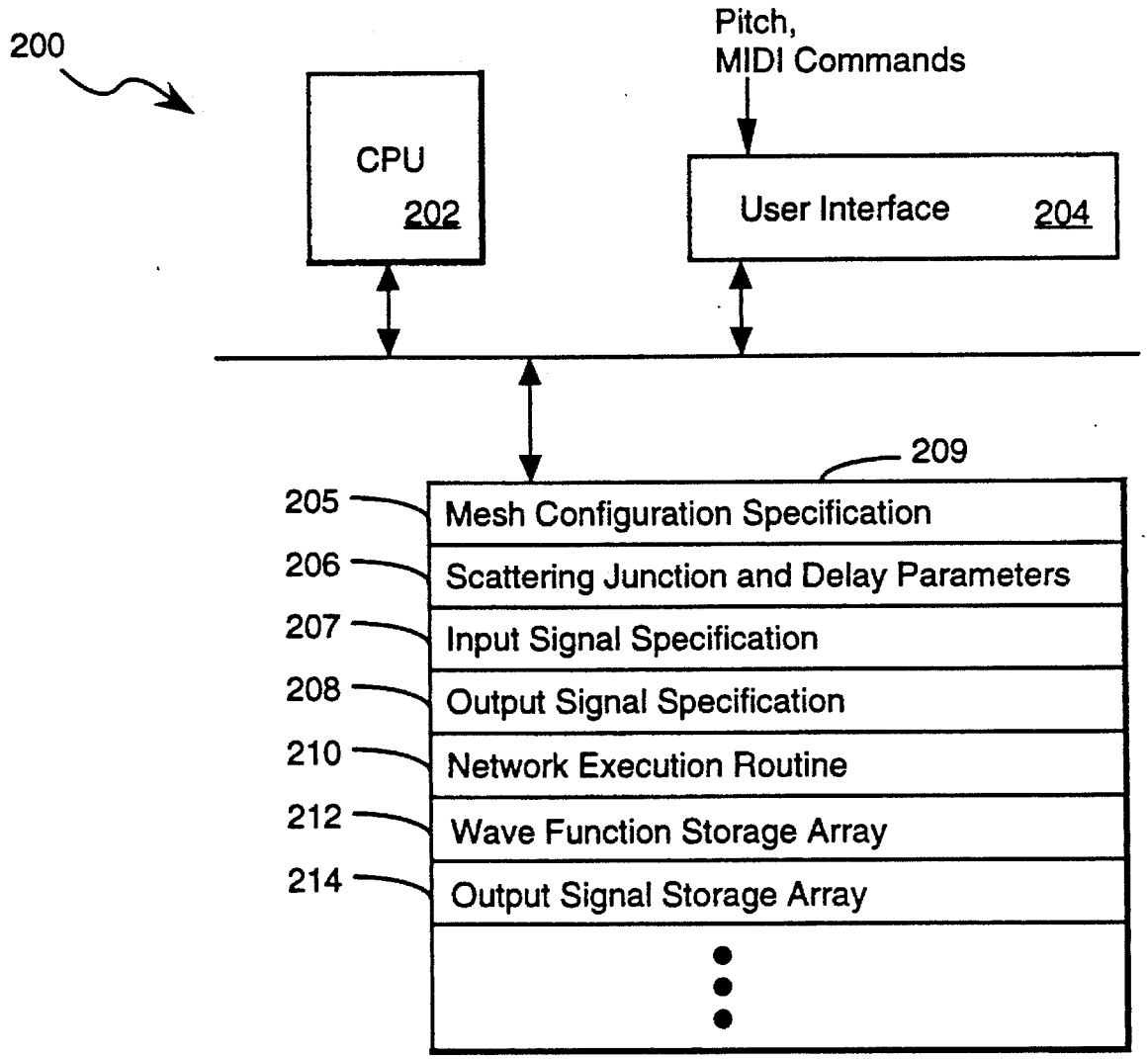
FIG. 50A and 50B show possible embodiment of the invention as a signal synthesis system.

Referring to FIG. 50, the present invention can be implemented on a conventional computer system 200 have a CPU 202 such as the 68040 made by Motorola and a user interface 204 that typically includes a monitor, keyboard, mouse pointer device and printer. A set of user specified parameters stored in arrays 205–208 in the system's memory 209 specify the configuration of the waveguide network, including specifications for interconnections between junctions, the scattering function used by each scattering junction, the excitation signals that drive the network and/or initial input conditions for the network, and an output signal specification. The output signal specification 208 may specify watched nodes of the network and combinations of the signals (such as the average of the signals on the specified nodes) on those watched nodes to be used as output signals. Using these parameters, a network execution program 210 executes the computations required to compute the signal values at each watched node, storing all required signal values and intermediate values in a storage array 212 set aside for that purpose, and storing vectors of output signal values in array 214.

Figure 50B:
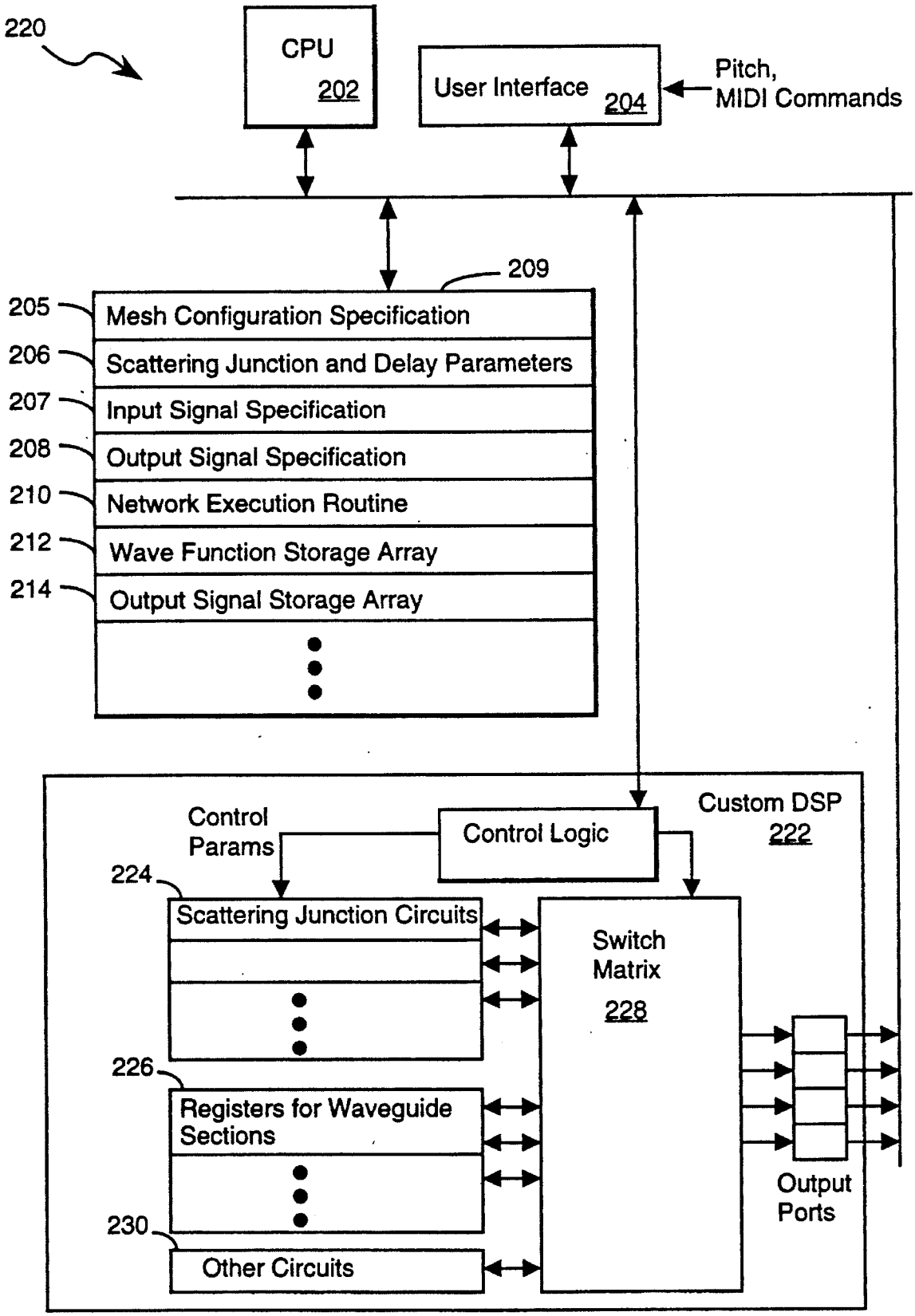

Referring to FIG. 50B, to execute a specified two-dimensional waveguide network in real time, it would preferable to utilize a system 220 that includes a host CPU 202 and a customized digital signal processor (DSP) 222. The preferred customized DSP includes an array 224 of parallel computational circuits for computing the signals produced by the network's scattering junctions, a register array 226 for storing intermediate signal values, and appropriate connection matrix 228 for conveying signal values between scattering junctions. The DSP 222 operates as a computational assistant to the host computer. As discussed above, in many two-dimensional waveguide networks, a large number of the scattering junctions can be implemented using only addition operations and no multiply operations, making it practical to have many parallel addition-only computational circuits in a customized digital signal processor. Scattering junctions that require multiply operations, which will often be smaller in number, could be executed either by the host CPU 202 or by a smaller array of mulitply circuits 230.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A signal synthesizer, comprising:

a digital waveguide network including a two-dimensional matrix of waveguide sections interconnected by junctions, wherein said matrix is formed by a two-dimensional pattern of said waveguide sections that is repeated in two distinct directions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein a majority of said junctions each interconnect at least three of said waveguide sections so as to scatter and intermix signals in said at least three waveguide sections;

at least one signal source, coupled to specified junctions of said digital waveguide network, which provides excitation signals to said digital waveguide network;

parameter storage for storing sets of control parameters, each set of control parameters including waveguide control parameters for controlling how said digital waveguide network filters signals propagating therethrough and signal source parameters which govern the excitation signals produced by said at least one signal source; wherein said waveguide control parameters in each said set of control parameters cause said digital waveguide network to simulate operation of a physical system modeled by said control parameters; and control means for operating said signal source and said digital waveguide network using a selected sets of said control parameters;

wherein said signals propagated by said waveguide sections simulate wave behavior of signals at spatial positions of said physical system corresponding to positions of said waveguide sections in said two-dimensional matrix.

2. The signal synthesizer of claim 1, wherein a majority of said junctions comprise no-multiply four-way scattering junctions, each no-multiply four-way scattering junction generating four output signals from four input signals using seven add/subtract operations and one shift/divide-by-two operation.

3. The signal synthesizer of claim 2, wherein wherein said no-multiply four-way scattering junctions are energy conserving no-multiply four-way scattering junctions.

4. The signal synthesizer of claim 2, wherein said no-multiply four-way scattering junctions are energy conserving no-multiply four-way scattering junctions;

said control means, for each no-multiply four-way scattering junction, adds said four input signals i1, i2, i3, i4 to produce a first temporary value vJ, determining whether a least significant bit of said first temporary value vJ2 is equal to 1, divides said temporary value vj2 by 2 by shifting said first temporary value vj2 by one bit position to produce a second temporary value vJ, generates said first output signal o1 by subtracting said first input value i1 from said second temporary value vJ, generates said second output signal o2 by subtracting said second input value i2 from said second temporary value vJ, generates a third output signal o3 by subtracting said third input value i3 from said second temporary value vJ and adding 1 thereto when said least significant bit of vJ2 is equal to 1, and generates a fourth output signal o4 by subtracting said fourth input value i4 from said second temporary value vJ and adding 1 thereto when said least significant bit of vJ2 is equal to 1.

5. A method of synthesizing signals, the steps of the method comprising:

storing in a computer memory sets of control parameters, each set of control parameters including signal source parameters which specify excitation signals, and waveguide control parameters specifying how to filter said excitation signals;

generating time varying excitation signals;

filtering said excitation signals with a two-dimensional digital waveguide network that includes a two-dimensional matrix of waveguide sections interconnected by junctions, wherein said matrix is formed by a two-dimensional pattern of said waveguide sections that is repeated in two distinct directions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein a majority of said junctions each interconnect at least three of said waveguide sections so as to scatter and intermix signals in said at least three waveguide sections;

operating said signal source and said digital waveguide network using selected sets of said stored control parameters;

wherein each said set of control parameters cause said digital waveguide network to simulate operation of a physical system modeled by said control parameters; and said signals propagated by said waveguide sections simulate wave behavior of signals at spatial positions of said physical system corresponding to positions of said waveguide sections in said two-dimensional matrix.

6. The signal synthesis method of claim 5, wherein a majority of said junctions comprise no-multiply four-way scattering junctions, said operating step including, for each no-multiply four-way scattering junction, generating four output signals o1, o2, o3, o4, from four input signals i1, i2, i3, i4 using seven add/subtract operations and one shift/divide-by-two operation.

7. The signal synthesis method of claim 6, wherein said no-multiply four-way scattering junctions are energy conserving no-multiply four-way scattering junctions.

8. The signal synthesis method of claim 6, wherein said no-multiply four-way scattering junctions are energy conserving no-multiply four-way scattering junctions;

said operating step including, for each no-multiply four-way scattering junction, adding said four input signals i1, i2, i3, i4 to produce a first temporary value vJ, determining whether a least significant bit of said first temporary value vJ2 is equal to 1, dividing said temporary value vj2 by 2 by shifting said first temporary value vj2 by one bit position to produce a second temporary value vJ, generating said first output signal o1 by subtracting said first input value i1 from said second temporary value vJ, generating said second output signal o2 by subtracting said second input value i2 from said second temporary value vJ, generating a third output signal o3 by subtracting said third input value i3 from said second temporary value vJ and adding 1 thereto when said least significant bit of vJ2 is equal to 1, and generating a fourth output signal o4 by subtracting said fourth input value i4 from said second temporary value vJ and adding 1 thereto when said least significant bit of vJ2 is equal to 1.

9. A signal synthesizer, comprising:

a digital waveguide network including a N-dimensional matrix of waveguide sections interconnected by junctions, wherein said matrix is formed by an N-dimensional pattern of said waveguide sections that is repeated in N distinct directions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein a majority of said junctions each interconnect at least three of said waveguide sections so as to scatter and intermix signals in said at least three waveguide sections;

at least one signal source, coupled to specified junctions of said digital waveguide network, which provides excitation signals to said digital waveguide network;

parameter storage for storing sets of control parameters, each set of control parameters including waveguide control parameters for controlling how said digital waveguide network filters signals propagating therethrough and signal source parameters which govern the excitation signals produced by said at least one signal source; wherein said waveguide control parameters in each said set of control parameters cause said digital waveguide network to simulate operation of a physical system modeled by said control parameters; and control means for operating said signal source and said digital waveguide network using a selected sets of said control parameters;

wherein N is an integer of value greater than 1, and said signals propagated by said waveguide sections simulate wave behavior of signals at spatial positions of a physical system corresponding to positions of said waveguide sections in said N-dimensional matrix.

10. A method of synthesizing signals, the steps of the method comprising:

storing in a computer memory sets of control parameters, each set of control parameters including signal source parameters which specify excitation signals, and waveguide control parameters specifying how to filter said excitation signals;

generating time varying excitation signals;

filtering said excitation signals with a N-dimensional digital waveguide network that includes a N-dimensional matrix of waveguide sections interconnected by junctions, wherein said matrix is formed by a N-dimensional pattern of said waveguide sections that is repeated in N distinct directions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein a majority of said junctions each interconnect at least three of said waveguide sections so as to scatter and intermix signals in said at least three waveguide sections;

operating said signal source and said digital waveguide network using selected sets of said stored control parameters;

wherein N is an integer of value greater than 1, each said set of control parameters cause said digital waveguide network to simulate operation of a physical system modeled by said control parameters, and said signals propagated by said waveguide sections simulate wave behavior of signals at spatial positions of said physical system corresponding to positions of said waveguide sections in said N-dimensional matrix.

* * * * *